US006932266B2

(12) United States Patent
Jones et al.

(10) Patent No.: US 6,932,266 B2
(45) Date of Patent: Aug. 23, 2005

(54) COLLAPSIBLE BULK MATERIAL CONTAINER

(75) Inventors: Robert J. Jones, Savage, MN (US); Michael R. Jones, Apple Valley, MN (US)

(73) Assignee: RMC Jones LLC, Savage, MN (US)

( * ) Notice: Subject to any disclaimer, the term of this patent is extended or adjusted under 35 U.S.C. 154(b) by 0 days.

(21) Appl. No.: 10/217,638

(22) Filed: Aug. 12, 2002

(65) Prior Publication Data

US 2003/0024971 A1 Feb. 6, 2003

Related U.S. Application Data

(63) Continuation-in-part of application No. 09/351,389, filed on Jul. 13, 1999, now Pat. No. 6,431,435.

(51) Int. Cl.[7] ..... B65D 5/92

(52) U.S. Cl. ..... 229/199; 229/164.1; 229/198.2; 229/122.32; 229/117.28; 229/109

(58) Field of Search ..... 229/164.1, 198.2, 229/199, 122.32, 117.28, 109; 383/119; 206/597

(56) References Cited

U.S. PATENT DOCUMENTS

| | | | | | |
|---|---|---|---|---|---|
| 49,390 | A | * | 8/1865 | Doolittle | 217/123 |
| 915,455 | A | | 3/1909 | Lynch, Jr. | |
| 920,637 | A | * | 5/1909 | Paar | 229/121 |
| 1,044,023 | A | | 11/1912 | Colgate | |
| 1,139,281 | A | | 5/1915 | Hazelton | |
| 1,794,821 | A | | 3/1931 | Andrews | |
| 2,056,956 | A | * | 10/1936 | Carpenter | 229/5.5 |
| 2,337,370 | A | | 12/1943 | Broadfoot | |
| 2,502,586 | A | | 4/1950 | Ottinger | |
| 2,611,526 | A | | 9/1952 | George | |
| 3,123,254 | A | * | 3/1964 | Rabby et al. | 222/105 |
| 3,257,068 | A | | 6/1966 | Wright | |
| 3,423,009 | A | | 1/1969 | Palmer | |
| 3,653,578 | A | | 4/1972 | Wood | |
| 3,779,448 | A | | 12/1973 | Wootten | |
| RE28,439 | E | | 6/1975 | Sherherd | |
| 3,896,991 | A | | 7/1975 | Kozlowski et al. | |
| 3,937,392 | A | | 2/1976 | Swisher | |
| 3,945,493 | A | | 3/1976 | Cardinal | |
| 3,957,195 | A | | 5/1976 | Lin | |
| 3,983,914 | A | * | 10/1976 | Benson | 141/390 |
| 4,013,168 | A | | 3/1977 | Bamburg et al. | |
| 4,115,909 | A | | 9/1978 | Corella | |
| 4,176,748 | A | | 12/1979 | Beane | |
| 4,226,327 | A | | 10/1980 | Ballard | |
| 4,308,905 | A | | 1/1982 | Gallagher | |

(Continued)

*Primary Examiner*—Tri M. Mai
(74) *Attorney, Agent, or Firm*—Merchant & Gould P.C.

(57) ABSTRACT

A container assembly for bulk materials and a kit for assembling same are disclosed. A forming member having a plurality of sidewalls defines an internal cavity for receiving bulk materials. The sidewalls are arranged relative to one another and are locked into position so as to define a geometric volume of predetermined shape, by means of a locking assembly. The locking assembly can be integrally attached to or can be separable from the sidewalls, and can form a bottom of the container assembly. A tubular sleeve of continuous material is sized to snugly engage and overlie substantially the entire outer surface area of the sidewalls. The sleeve provides the containment strength, while the forming member provides structural shape and stability to the container assembly. Additional layers of corrugated material or woven polypropylene material or their combination may be used as inserts engaging the inner peripheral sidewall areas of the forming member to provide additional strength to the container assembly. The forming member sidewalls may be freely slidable relative to one another or may be slidably affixed to one another by releasable glue.

39 Claims, 17 Drawing Sheets

U.S. PATENT DOCUMENTS 4,337,888 A 7/1982 Kudalkar
4,362,199 A 12/1982 Futerman
RE31,191 E 3/1983 Connolly
4,457,483 A * 7/1984 Gagne ..... 248/97
4,538,385 A * 9/1985 Kandarian ..... 150/154
4,622,693 A 11/1986 Mykleby
4,655,366 A * 4/1987 Sykes ..... 229/122.33
4,666,059 A 5/1987 Nordstrom
4,850,506 A * 7/1989 Heaps et al. ..... 229/117.3
4,868,955 A * 9/1989 Magnant et al. ..... 24/306
4,903,431 A 2/1990 Stoll
4,997,125 A 3/1991 Glerum
5,158,369 A 10/1992 Derby
5,165,568 A 11/1992 Wischusen, III
5,226,544 A * 7/1993 Gallucci et al. ..... 206/597
5,285,957 A 2/1994 Halsell
5,340,217 A 8/1994 Rothman
5,405,006 A 4/1995 Burgdorf et al.
5,518,168 A 5/1996 Mayer
5,566,531 A 10/1996 Nordstrom et al.
5,758,973 A 6/1998 LaFleur
5,759,644 A 6/1998 Stanley
5,772,108 A 6/1998 Ruggiere, Sr. et al.
6,431,435 B1 * 8/2002 Jones et al. ..... 229/117.28

* cited by examiner

COLLAPSIBLE BULK MATERIAL CONTAINER

This is a Continuation-in-Part of U.S. patent application Ser. No. 09/351,389, filed Jul. 13, 1999 now U.S. Pat. No. 6,456,435.

FIELD OF THE INVENTION

This invention relates generally to shipping and storage containers, and more particularly to a container for bulk, liquid and granular materials, which is collapsible and/or reusable or recyclable.

BACKGROUND OF THE INVENTION

Effective, reliable, safe and economical packaging of bulk products for handling, transport and storage has been a concern for many years. Bulk products requiring such packaging vary widely from semi-solids such as meat and other such food items; to granular materials such as beans, peas, grains, rice, salt, flour, sugar, dry chemicals, dry cementious products, animal feeds, fertilizers, etc.; to liquid materials such as syrups, milk, juices, glues, inks, resins, paints, chemicals, and the like. Since such materials have a tendency to move or flow, containment of them for shipment, handling and storage raises many challenges. It is desirable to package such materials in containers that can be readily transported by truck, rail or ship and that can be easily handled during transport and at a final destination such as at a processing facility by readily available equipment such as fork lifts, cranes and the like. The flowable nature of such products presents unique packaging issues for the container. Movement or shifting of the materials during transport can cause deformation of the container that can result in load shifting and instability and bursting containers, often with enough force to damage or destroy the container. The result is loss or damage to the container contents and undue cleanup and environmental concerns. The containers must even be more stable if stacked on top of each other.

The packaging industry has, to date, generally used two primary containment approaches: (1) corrugated bulk box containers (both plastic and paper); and (2) large bulk bags of woven fabric generally referred to as flexible intermediate bulk containers (FIBCs). Both approaches use various configurations of liners, typically made of polyethylene or polypropylene, that fit within the corrugated bulk box or within the FIBC for preventing contamination of the product being shipped and, in the case of a liquid product, to contain the liquid. Both packaging approaches use containers typically configured to be supported by and carried on pallets.

Utilizing the corrugated bulk box approach, the container strength needed to handle the wide variety of weight and product consistency requirements is addressed by using different strength grades of corrugated board materials and/or by increasing the wall thickness of the boxes by gluing corrugated sheets together or by inserting a corrugated sleeve into the box. Another approach for strengthening the box container is to wrap a number of plastic or steel straps around the outside periphery of the box. Both techniques suffer shortcomings. The price of the bulk box significantly increases with increased wall thickness and/or higher quality corrugated materials. If the box board wall strength and/or thickness is reduced in order to cut costs, and a number of external support straps or bands are used, product pressure against the thinner box walls generally causes the box to bulge outwardly between the straps, resulting in a container having marginal safety factor and leading to numerous costly box failures in shipment.

The FIBCs utilize various fabrics (such as woven polypropylene and PVC coated fabrics) and various fabric weights and sewing methods, depending on the necessary strength of the bag and its desired factor of safety. Such bags vary in size to generally hold from 5 to 120 cubic feet of material and up to about 5,000 pounds of product. They generally can be designed with various shaped tops suitable for filling, can have a solid bottom or a sewn-in discharge spout configuration, and have lifting handles. For dry or fluidized products that require a more rigid bag for stability, solid support inserts may be placed inside the bag, and between the outer bag surface and a liner (if one is used) to provide the bag's sidewalls with more rigidity. Because of the cost of the manufacturing sewing operations and the cost of the rigidity enhancing inserts used in the FIBCs, they typically result in a more expensive container than their corrugated box with strapping counterparts. If used without significant rigidity supports to store liquid materials, the FIBC bag will act like a large water balloon; thereby making the FIBCs more practical for use in shipping and storing dry bulk products instead of liquid or semi-liquid materials. Further, the inserts that are typically placed within the FIBCs to provide sidewall rigidity are typically joined/hinged at their corners to fold down flat when not in use, and do not have bottoms. Without rigid bottoms, the inserts are susceptible to significant deformation from their intended footprint configuration during loading of the FIBC, resulting in a misshaped containment system that is unstable before and during shipment. To address this problem, collapsible metal grid cages have been configured to externally support the FIBC, further adding to the cost and use inflexibility of such systems for containing liquids or semi-liquid materials.

The present invention addresses the problems and shortcomings of both the prior corrugated box and the FIBC containment systems. The present invention combines the strength of woven polypropylene materials used in the FIBC technology with unique configurations of forming members and inserts using corrugated box technology, to create a very strong container that is easy to set up, generally maintains its shape for stacking, which is significantly more cost effective, and which is safer and more reliable than heretofore known packaging methods.

SUMMARY OF THE INVENTION

This invention uses existing industry accepted packaging materials to form a unique bulk container system that is universally applicable to the packaging of solid, semi-solid, granular or liquid materials. The bulk container system of this invention combines the advantageous features of known packaging techniques in a unique manner without suffering their respective shortcomings. A forming member of relatively inexpensive lightweight corrugated material is used to define an internal geometric volumetric shape of the container in a manner that provides shape to the container and structural support for enabling stacking of loaded/filled containers. The forming member is collapsible for storage and transport and is easily erected by folding to an operable box-like configuration. The forming member has a unique bottom design that when assembled, squares-up and locks the forming member sidewalls in predetermined positions to define a desired geometric volume. The forming member is designed to be placed on and carried by a pallet.

An outer tubular sleeve, that can be configured without stitching or seams, is sized to surround and snugly engage the entire outer peripheral sidewall areas of the forming member, and assumes the defined geometric shape of the outer surface of the forming member. The sleeve, preferably of woven polypropylene material, provides the necessary strength for containing the bulk material within the forming member, while the forming member provides the desired rigidity and shape to the system. Additional layers of the woven polypropylene may be used around the forming member to provide additional strength. The forming member and the outer sleeve(s), together, form a stable, multipurpose and universal container system configuration that is less expensive than either corrugated or FIBC known container configurations. As an option, additional layers of corrugated material or woven polypropylene material or their combination may be used as inserts engaging the inner peripheral sidewall areas of the forming member to provide additional strength. All the forming member, sleeve, and insert components of the container system can be collapsed for reuse depending on the particular use application and sanitation requirements, and are completely recyclable. A standard bag/liner can be and typically is placed within the forming member or within the insert to protect the contents from contamination or the environment and/or to retain liquids.

The forming member, the outer sleeve, and the inserts can be configured to any desired shape, as dictated by the intended use of the container system. The size of the container and the weight of its contents will dictate the strength of the outer sleeve or the inner insert, if of woven polypropylene material, which will be of a food grade fabric for food containment applications. The invention also includes forming member and inner insert configurations that allow relative movement between cooperating portions thereof, such that the forming member or the insert can expand and contract with the contained contents of the system. Another feature of the invention is a forming member or inner insert design that maintains a given footprint configuration of the container, but which allows the upper portion of the container to reconfigure along predetermined expansion lines to reduce stress across the forming member or insert sidewalls.

According to one aspect of the invention, there is provided a container for bulk materials comprising: (a) a forming member comprising a plurality of sidewalls extending between upper and lower edges and interconnected to cooperatively form an outer surface and to encircle an internal cavity for receiving bulk materials; and a locking assembly cooperatively engaging the sidewalls to define and fix predetermined relative positions there among; and (b) a sleeve of continuous, woven material sized to snugly engage and to overlie substantially the entire said outer surface of said sidewalls between said upper and lower edges, wherein said sleeve is configured with a fold extending from the lower edges of the sidewalls towards said internal cavity. According to a further aspect of the invention, the forming member comprises a single piece of material and may have sidewalls of corrugated construction and may be collapsible when said locking assembly is not operable to fix the positions of said sidewalls. According to yet a further aspect of the invention, the sleeve can be operatively positioned overlying said forming member by sliding the sleeve over the sidewalls, from either their said upper or lower edges. According to yet a further aspect of the invention the sleeve is tubular in shape and of substantially the same cross-sectional dimension across its entire length and may be of polypropylene material. According to yet a further aspect of the invention the sleeve is further folded back upon itself adjacent said lower edge of the sidewalls to provide additional strength to the sleeve adjacent the lower edge. According to yet a further aspect of the invention the sidewalls include foldable tabs alongside some of said upper edges of said sidewalls to enhance stacking and are configured to slidably engage one another to provide for limited relative movement thereof. According to yet a further aspect of the invention at least two of said sidewalls may be glued to each other, either by use of a releasable glue allowing relative sliding movement between the sidewalls under sufficient sheer forces, or by conventional glue techniques. According to yet a further aspect of the invention, the container may include a liner of impervious material, sized, and configured for placement within the internal cavity, and the container may have forming member sidewalls wherein the lower edges are configured to be supported by a pallet.

According to yet a further aspect of the invention there is provided a kit for a bulk material container, comprising: (a) a forming member comprising a plurality of sidewalls extending between first and second edges and interconnectable to cooperatively form an outer surface and to encircle an internal cavity for receiving bulk materials, and a locking assembly configured to cooperatively engage the sidewalls to define and fix predetermined relative positions there among; and (b) a sleeve of continuous material sized to snugly engage and to overlie substantially the entire said outer surface of said sidewalls.

According to yet a further aspect of the invention there is provided a container for bulk materials comprising (a) a forming member, comprising a plurality of sidewalls extending between upper and lower edges and interconnected to cooperatively form an outer surface and to encircle an internal cavity for receiving bulk materials, and a locking assembly cooperatively engaging the sidewalls to define and fix predetermined relative positions there among; (b) a sleeve of continuous material sized to snugly slidably engage and to overlie substantially the entire said outer surface of said sidewalls between said upper and lower edges, wherein said sleeve is configured to retain the upright shape of said forming member outer surface as bulk materials are loaded into said internal cavity; and (c) an insert member sized and configured for placement within said internal cavity.

According to yet a further aspect of the invention the insert member comprises corrugated material. According to yet a further aspect of the invention the insert member comprises a plurality of sidewalls extending between upper and lower edges and slidably interconnected to cooperatively encircle an internal cavity for receiving bulk materials. According to yet a further aspect of the invention the insert member comprises a locking assembly cooperatively engaging the sidewalls to define and fix predetermined positions of the sidewalls relative to one another, while permitting limited movement of said sidewalls relative to each other and to the locking assembly. According to yet a further aspect of the invention the insert member is collapsible when the locking assembly is not operable to fix the positions of said sidewalls. According to yet a further aspect of the invention there is provided the locking assembly that engages said sidewalls along said lower edges and may form a bottom of the insert member and extending across the internal cavity. According to yet a further aspect of the invention the insert member comprises continuous, woven material. According to yet a further aspect of the invention the insert member is slidably disposed relative to said forming member. According to yet a further aspect of the invention the insert member is tubular in shape and of substantially the same cross-sectional dimension across its entire length and may comprise polypropylene material.

According to yet a further aspect of the invention the sleeve comprises woven material. According to yet a further aspect of the invention the sleeve can be operatively positioned overlying said forming member by sliding the sleeve over the sidewalls, from either their said upper or lower edges. According to yet a further aspect of the invention the sleeve is tubular in shape and of substantially the same cross-sectional dimension across its entire length and may comprise polypropylene material. According to yet a further aspect of the invention the sleeve is configured with a fold extending upward from the lower edges of the sidewalls to provide multiple strength resistance to forces directed outwardly from the internal cavity. According to yet a further aspect of the invention, the sleeve is configured with a fold extending from the lower edges of the sidewalls towards said internal cavity to provide strength resistance to forces directed outwardly and downwardly from the internal cavity adjacent the lower edges of said sidewalls. According to yet a further aspect of the invention, the sleeve is further folded back upon itself adjacent said lower edge of the sidewalls to provide additional strength to said sleeve adjacent the lower edge. According to yet a further aspect of the invention the container may include a liner of impervious material, sized and configured for placement within said insert.

According to yet a further aspect of the invention there is provided a kit for a bulk material container, further comprising an insert member sized and configured for placement within said internal cavity.

According to yet a further aspect of the invention, there is provided a method of configuring a container for bulk materials, comprising the steps of: (a) providing a forming member of the type having a plurality of sidewalls extending between first and second edges; (b) arranging said sidewalls in a closed manner such that they collectively define an internal cavity longitudinally extending between planes defined by the first and second edges; (c) providing a locking assembly; (d) engaging the locking assembly with the sidewalls to fix the geometric shape of the internal cavity defined thereby; (e) providing a circumferentially continuous length of tubular sleeve material; and (f) snugly engaging the tubular sleeve around the outer periphery of the sidewalls such that the sleeve engages substantially the entire outer surface area of said sidewalls. According to yet a further aspect of the invention, the forming member sidewalls are provided with a releasable glue that allows for relative sliding movement of said sidewalls under appropriate loading force conditions.

These and other features of the invention will become apparent upon a more detailed description of preferred embodiment of the invention as described below.

BRIEF DESCRIPTION OF THE DRAWINGS

Referring to the Drawing, wherein like numerals represent like parts throughout the several views.

DETAILED DESCRIPTION OF THE PREFERRED EMBODIMENT

Figure 1:
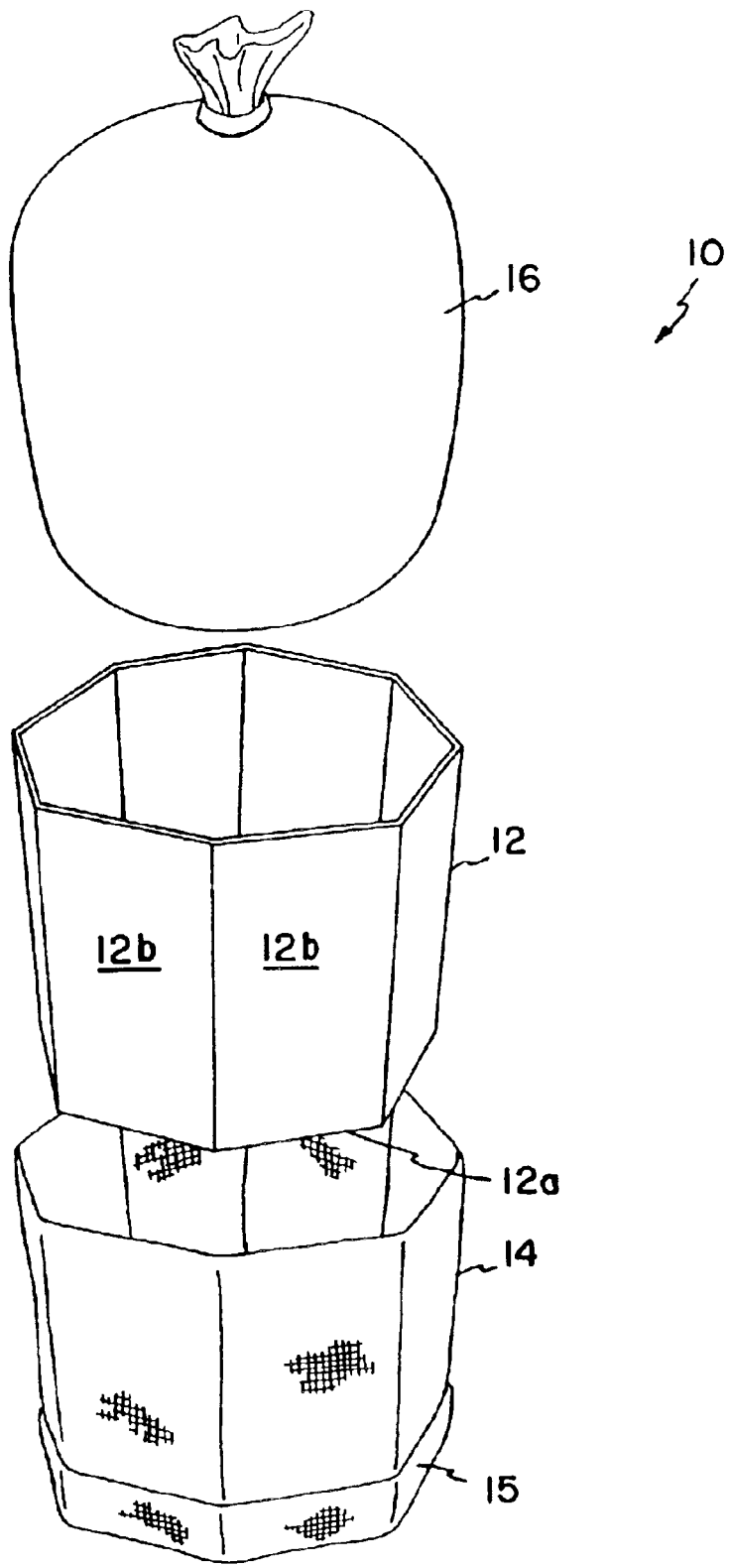
FIG. 1 is an exploded perspective view of a bulk material container assembly containing a forming member, an outer sleeve member and an optional bag/liner of impervious material.
Figure 2:
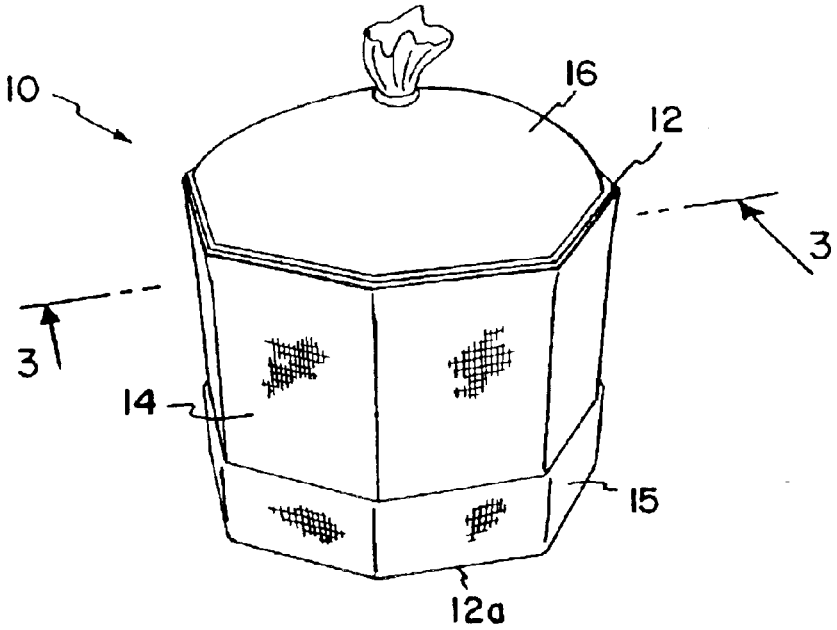
FIG. 2 is a perspective view of the container assembly of FIG. 1, illustrated as it would appear assembled.

A preferred embodiment of a container system incorporating the principles of this invention is generally illustrated at 10 in FIGS. 1 and 2. The two basic components of the container system are a forming member, generally indicated at 12 and an outer support sleeve member 14. The forming member 12 provides defined geometric shape and structure to the container system while the sleeve member 14 is sized to cooperatively and snugly engage and circumferentially surround substantially the entire sidewall portions of the forming member 12, as hereinafter discussed in more detail. An optional bag/liner, well-known in the art generally indicated at 16 can be and generally is placed within the forming member 12, to protect the container contents from contamination and/or to retain liquid contents.

The forming member 12 is preferably configured of a relatively light-weight corrugated material which can be either of cellulose or plastic construction. When collapsed, the forming member 12 can be configured as a single planar sheet, or, depending upon the particular construction, folded over on itself in a collapsed manner. When erected in operative manner, the forming member 12 includes a bottom construction that provides a predetermined two-dimensional geometric configuration to the bottom of the forming member. The sidewalls 12*b* of the forming member extend upwardly and generally perpendicular to the plane of the bottom 12*a* and collectively define with the bottom an internal geometric volume that represents the storage portion of the container system. The forming member 12 is configured to lie upon and be carried by a pallet of a type well-known in the shipping industry. Depending upon the size of the forming member, one or more of such forming members may lie on the same pallet. The thickness and strength of the corrugated material of the forming member 12 is a matter of engineering design and will vary depending on the shape and size of the container and upon the type and weight of the materials to be contained thereby. However, the thickness and strength thereof can be significantly reduced as compared to standard corrugated containers, since the wall portions of the forming member do not have to provide the containment strength of the container system. Their function is to simply provide structural shape to the outer wall areas of the container, so as to provide a measure of rigidity and stability to the container system. The height, size, shape and dimensions of the forming member can also vary, as desired or dictated by the use to which the container system will be put. When used to replace FIBC containers, the forming member could be sized to accommodate a typical pallet grid unit which would enable shippers and users of the container system to handle the system with existing in-plant equipment such as fork lifts, overhead cranes or jib cranes. As with prior containers, the container system of this invention can be tailored in size and shape to fit each customer's needs. For example, the container systems could be configured to accommodate packaging needs as small as five cubic feet for handling high bulk density weight products or could be configured to handle much larger sizes up to, for example, 120 cubic feet.

While a preferred construction of the forming member is one in which the entire forming member is configured from a single planar sheet or blank of corrugated material, the invention does not require a one-piece construction. For example, the sidewall 12*b* portions of the forming member could be formed from a single sheet of material; whereas the bottom 12*a* could be formed from a second, separable piece of material. The important aspect of the forming member 12 is that it contain a bottom or similar structure that gives initial predetermined fixed geometric definition to the sidewall portions of the forming member, and particularly to the lower base portions thereof. It is preferable that the bottom portion 12*b* of the forming member be secured to the sidewalls 12*a* in a manner that will prevent the sidewalls from riding or sliding upward, away from the bottom of the forming member during filling of the container. Further, while the preferred embodiment will be described with respect to forming members that are constructed from the same corrugated material, the invention does not require the same material to be used for both the sidewall 12*b* and bottom or shape defining portions 12*a* of the forming member.

The cellulose corrugated material used in a preferred embodiment of the invention for the forming member 12 may be obtained from any corrugated material supplier such as from Menasha Corp. of Lakeville, Minn. or from the Packaging Corporation of America. Plastic corrugated materials could also be obtained from any number of different suppliers such as Menasha Corp. or Liberty Carton of St. Louis Park, Minn. As mentioned above, the weight and strength of the corrugated material depends on the application to which the container system will be put, and the method of use of the container. In general, this invention allows use of a relatively inexpensive material, since the primary containment strength of the container system will not depend on the strength of the forming member material, but rather on the strength of the outer sleeve 14. For example, for smaller containers a single weight 175 lb. C flute material might be adequate; whereas for even larger containers that might hold up to 2,000 pounds of material, a relatively low weight corrugation in the 200 lb. to 275 lb. C flute material range may suffice. In contrast, for the same application, a prior art total cardboard corrugation construction may require several layers of double wall 400 lb. to 500 lb. weight materials to achieve the same purpose. Often, the prior art corrugated materials also would require the insertion of filament tape between the flutes to provide additional support and/or cross fluted configurations and gluing of the respective corrugated layers to one another to form a strengthened laminated configuration.

Figure 4A:
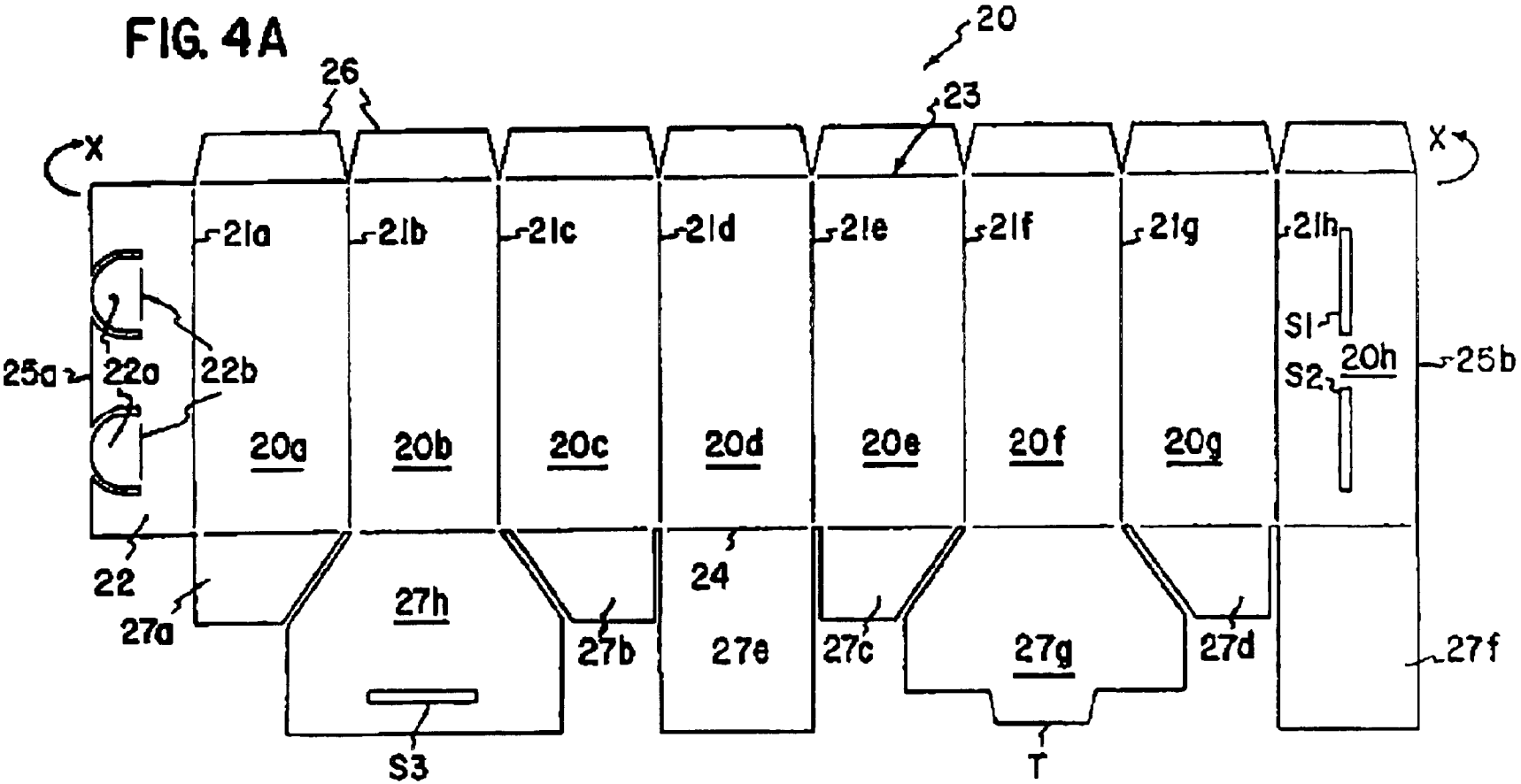
FIG. 4A is a view illustrating on a planar sheet the cut and fold pattern of a first embodiment of a corrugated forming member portion of the container assembly of FIG. 1.

A first embodiment of the forming member, constructed from corrugated cellulose (cardboard) material, is illustrated at 20 in FIGS. 4A–4D. In the preferred embodiment, the forming member 20 is configured from a single piece of corrugated material that is scored and patterned for folding, as illustrated in FIG. 4A. Referring thereto, the forming member 20 has eight sidewall portions 20*a*–20*h* consecutively connected and defined by intervening fold lines 21*a*–21*h* respectively, which eventually define the eight "corners" of the forming member. A connecting wall member 22 is contiguous with sidewall 20*a* and extends outwardly from fold line 21*a*. Connector wall 22 has a pair of arcuate tabs 22*a* cut into the wall and projecting back from the side edge 25*a* back to fold lines 22*b*. The forming member 20 also has an upper edge 23, a lower edge fold line 24 and oppositely disposed side edges 25*a* and 25*b*. Each of the sidewalls 20*a*–20*h* has a tab 26 projecting upwardly therefrom that folds along the upper edge 23 of the forming member. The ends of the tabs 26 are cut at a taper from the respective fold lines 21*a*–21*h* and the end 25*b* so as to minimize interference with one another when folded in toward the center of the structure.

The forming member 20 also has a plurality of downwardly depending tab portions 27*a*–27*h* which collectively define the bottom 28 of the forming member 20, as hereinafter described. End wall 20*h* includes a pair of vertically aligned slots S1 and S2 for cooperatively receiving the arcuate tabs 22*a* of the connector wall 22. Bottom tab 27*g* also has an extended key member, generally designated at T. Bottom tab 27*h* has a horizontal slot S3 cooperatively sized for accepting the extended key member T of bottom tab 27*g*.

Figure 4D:
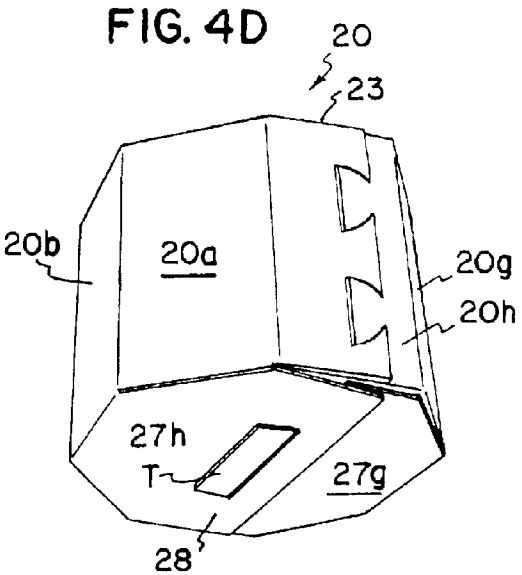
FIGS. 4B–4D illustrate bottom perspective views of the corrugated forming member of FIG. 4A, showing progressive stages of folding of its various segments to derive an operative closed bottom configuration of the first embodiment forming member.
Figure 4C:
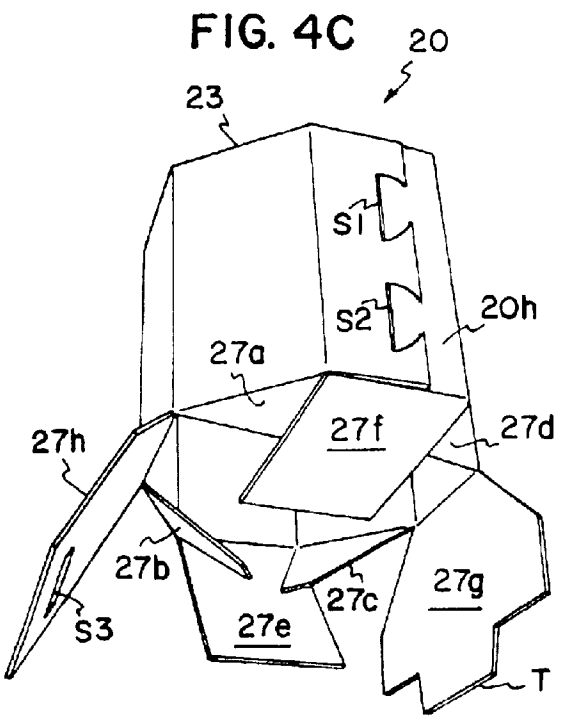
Figure 4B:
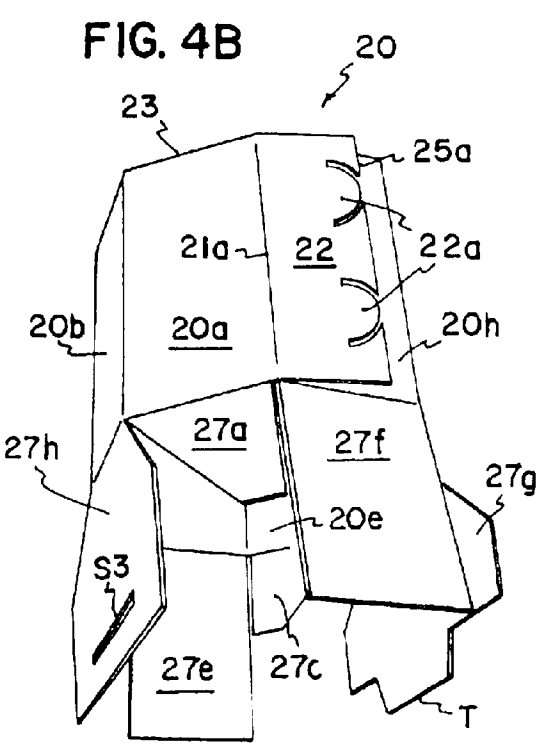

The forming member patterned blank material of FIG. 4A is progressively folded as illustrated in FIGS. 4B–4D, until a box-like octagonal receptacle is configured, with bottom 28 is defined, as illustrated in FIG. 4D. To form the box-like receptacle configuration, the material illustrated in the FIG. 4A pattern is folded along the wall fold lines 21 so that the side edges 25*a* and 25*b* move toward one another (illustrated by "X"), and until the side edge 25*a* engages the slots S1 and S2 of sidewall 20*h* such that the arcuate tab members 22*a* are slidably received within the slots S1 and S2. The upper tabs 26 are folded inward, along the upper edge 23. In this position, the connecting wall 22 overlies the end sidewall 20*h* and is connected thereto by means of the tabs 22*a* and slots S1 and S2 combination. At this stage, the forming member 20 would appear as illustrated in FIG. 4B. At this point, the structure is still foldable upon itself and can be folded into a collapsed position, since the bottom 28 has not yet been formed.

The bottom 28 of the forming member 20 is defined by folding in the lower tab extensions 27, toward the center of the enclosed cavity defined by the connected sidewalls 20. The angled tabs 27*a*, 27*b*, 27*c* and 27*d* are folded in first, followed by tabs 27*e* and 27*f*, and finally by tabs 27*g* and 27*h*. The distal key end (T) of bottom tab 27*g* is received by and retained within the slot S3 of tab 27*h*, in interlocking manner, to complete and hold the bottom assembly 28 in place, as illustrated in FIG. 4D. Such bottom configuration 28 not only defines but locks in the positions of the sidewalls. The inner sidewalls and bottom portions of the assembled forming member 20 collectively define an internal geometric solid shaped cavity as established and maintained by the outer peripheral edge shape or "footprint" of the plane of the bottom 28. According to a preferred configuration of the FIG. 4 structure, each of the sidewalls is 17.875 inches wide, providing a diameter footprint of 43×43 inches and a circumference of 143 inches. According to the preferred embodiment, the height of the container from the bottom edge 24 to the upper edge 23 is 44 inches.

It will be noted that in this illustrated embodiment of a forming member, the tab members 22*a* are slidable within the slots S1 and S2. Such sliding construction provides for limited relative movement of the sidewall configuration to accommodate expansion and contraction of the material being contained by the container assembly. Such movement prevents rupturing of the forming member within the outer sleeve that might otherwise occur if the forming member ends were fixedly glued together. Also, such expansion feature accommodates any tolerance differences between the circumferences of the outer surface of the forming member and the inner surface of the tubular sleeve.

Although the preferred embodiment of the forming member includes a sidewall construction wherein the sidewalls are slidably expandable as above-described, the sidewalls may be fixedly secured for no movement relative to one another. For example, the connecting wall 22 can be glued in standard fashion to the end sidewall 20*h* to provide for further structural integrity and rigidity, especially for stacking purposes. In such embodiment, even if the forming member were to subsequently rupture, since the outer sleeve 14 will continue to withstand the loading pressure, the containment system would still serve its purpose. Gluing of the corrugated forming member sidewalls is always an option whenever there is an accompanying outer sleeve member constructed of woven polypropylene material surrounding the forming member. Gluing of the forming member sidewalls may be attractive to some container manufacturers since the material blank member from which the forming member is configured can be made from less material than might otherwise be used if an expandable slot/tab configuration is used to accommodate a slidable sidewall configuration such as described with respect to FIG. 4. Gluing would also eliminate the need for a container manufacturing step of assembling the forming member (such as described in FIGS. 4B–4D) before use thereof in the container system. Gluing of the forming member may also provide additional rigidity to the containment system structure when an insert (hereinafter described in more detail) is used in combination with the forming member and an outer sleeve. Gluing, although not necessary, provides more rigidity for stacking purposes. Traditional gluing of the forming member sidewalls, although reducing the accommodation of expansion or contraction of the material being contained by the corrugated member, does not defeat the purpose of the invention since all the container loading pressure is still absorbed by the surrounding sleeve member in case of rupturing of the corrugated member.

Another embodiment of a forming member construction that accommodates both the desire for use of a smaller blank of forming member material and the advantages of slidably movable sidewalls is to configure the forming member in the same manner as one would when permanently gluing the sidewalls to one another, but to use a glue that is "releasable" in nature when subjected to a predetermined sheer force that is less than the sheer rupture parameter of the material to which the glue is applied. With the use of such releasable glue, the glue would have enough bonding strength to affix the sidewalls together for handling and transportation purposes, as though the forming member sidewalls were permanently glued to one another. However, the releasable glue would be applied in a manner and selected for properties such that as the container is being filled and pressure is being applied by the load to the forming member sidewalls, the glue in the sidewall joint will release the sidewalls at the joint from one another, enabling the sidewalls at the joint to move/slide in expansion manner relative to one another, before the load pressure applied to the sidewalls is large enough to cause the sidewall material to rupture. When the expansion force that provides the release sheer forces on the glue has subsided, the releasable glue will once again form a bond between the sidewalls at the "glued" joint. Therefore, this configuration provides the advantages of both an expandable, slidable forming member that also acts as a glued structure when harmful expansion forces are not present. Those skilled in the art can select the proper glue and application techniques for accomplishing the described configuration. Releasable glues that have been found to be acceptable for these purposes are sold by H. B. Fuller Company under its PD0661 and AP6903 labels. Such glue can be applied by standard glue application techniques such as by extrusion or spraying. Alternatively, hot melt glue applications could be used that would provide the aforementioned desired glued joint slip/release properties. By using such slip/release glued sidewall joint technique, it has been found that a sidewall overlap of from 4 to 5 inches at the glue joint is adequate to provide the desired slip joint tolerance and forming member rigidity parameters, which is generally less than the amount of forming member overlap material required to form a non-glued slip joint.

Figure 5A:
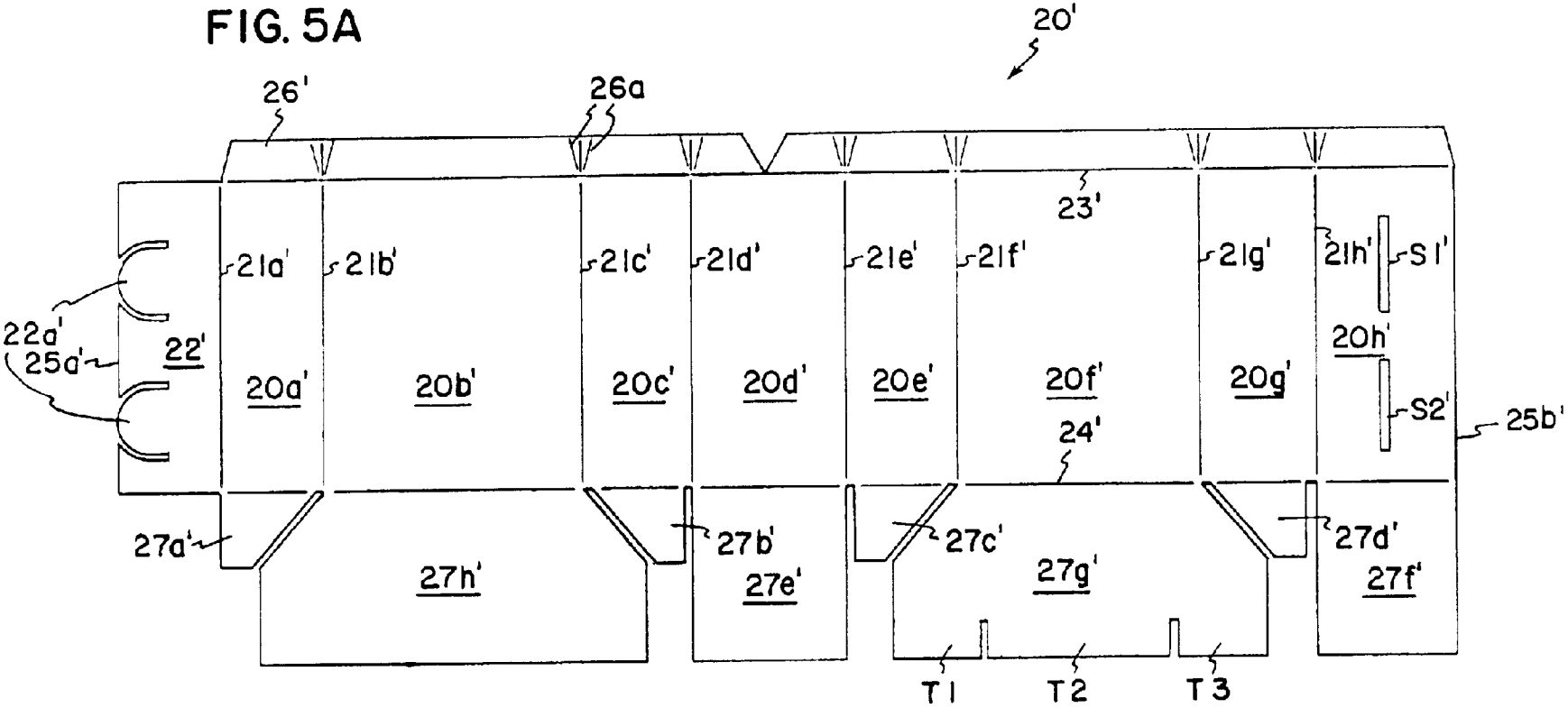
FIG. 5A is a view illustrating on a planar sheet the cut and fold patterns of a second embodiment of a corrugated forming member portion of the container assembly of FIG. 1.
Figure 5D:
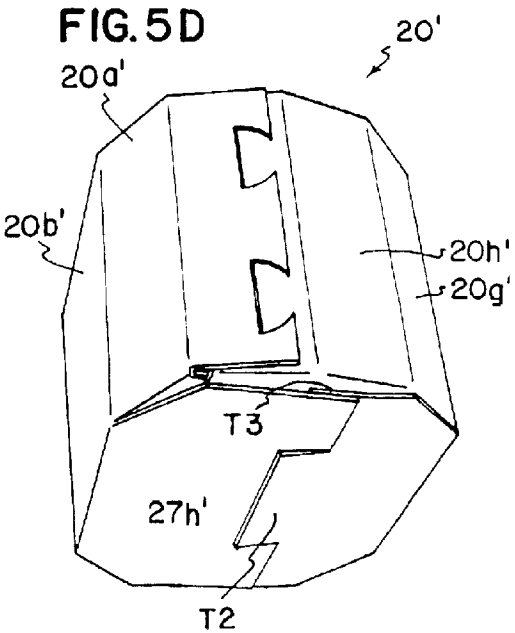
FIGS. 5B–5D illustrate bottom perspective views of the corrugated forming member of FIG. 5A showing progressive stages of folding of its various segments to derive an operative closed bottom configuration of the second embodiment forming member.
Figure 5C:
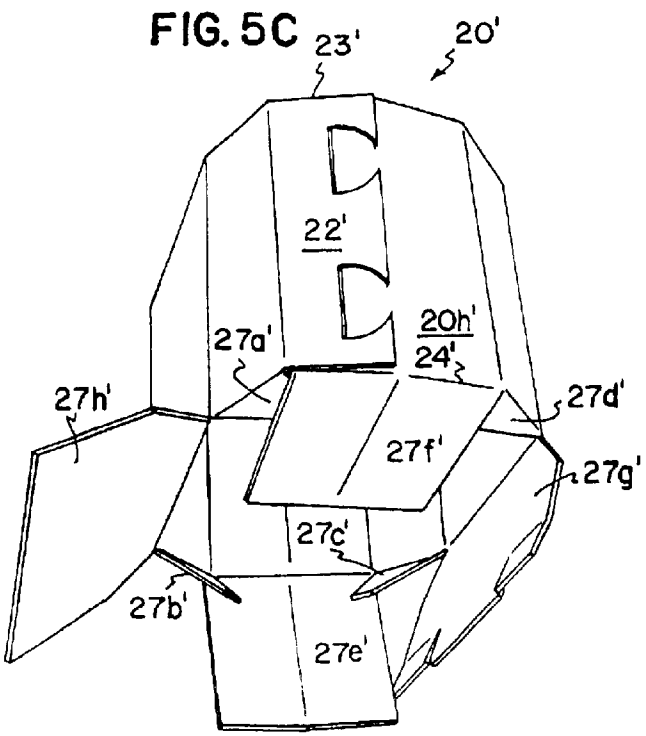
Figure 5B:
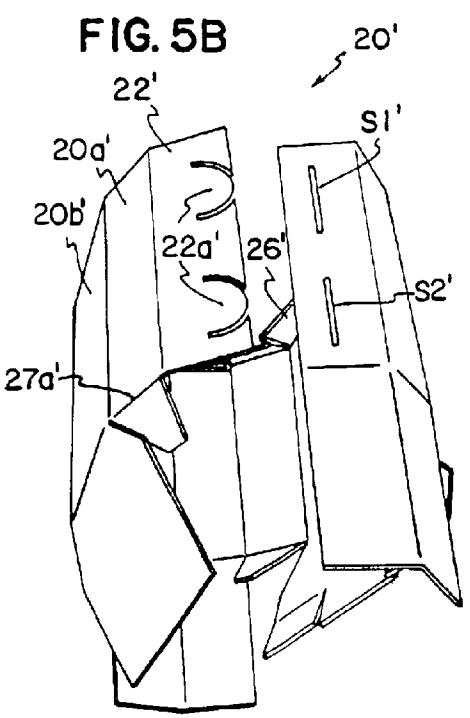

A second octagonal embodiment of a forming member 20' is illustrated in FIGS. 5A–5D. The general function and folding pattern of the corrugated sheet defining the forming member 20' is basically the same as that of the forming member 20 with the following changes: (1) the uniform width dimension of the sidewalls has been changed to an irregular width pattern; (2) the upper individual tabs 26 of the forming member 20 have been replaced by a pair of elongate tabs 26' having fold score marks 26*a* replacing the notched cuts of the forming member 20 pattern; and (3) the slot S3 of bottom tab 27*h* has been deleted in bottom tab 27*h'* of the second forming member, and the lower edge of bottom 27*g'* has been reconfigured to include three tabs T1, T2 and T3, separated by a pair of notches. When assembled as illustrated in FIG. 5D, the second embodiment forming member 20' provides a more elongated octagonal structure than the regular rectangular structure of the FIG. 4 forming member.

A third embodiment of a forming member is illustrated generally at 30 in FIGS. 6A–6E. Referring thereto, the third embodiment of the forming member is a four sided container when assembled, with its four primary sidewalls represented by the panels 31*a*–31*d*. The corners of the sidewalls 31*a*–31*d* are defined by the vertical fold lines 32*a*–32*d*. The forming member includes a connector wall extension 33 having an upper arcuate connecting tab 33*a* and a lower connecting tab 33*b*, both terminating at a first edge 34*a* of the forming member. The opposite vertical edge of the forming member 34*b* defines one edge of the sidewall 31*d*. The upper edge of the forming member is designated at 35, and the lower edge of the sidewalls is defined by the first horizontal fold line 36. The forming member includes two additional horizontal fold lines 37 and 38 extending the full width of the pattern. The vertical distance between the fold lines 36 and 37 is the same as that between fold lines 37 and 38. A first horizontal panel 39 is defined and extends the entire width of the pattern between the horizontal fold lines 36 and 37. A second horizontal panel 40 is defined and extends the entire width of the pattern between the horizontal fold lines 37 and 38. The panel 40 includes a cantilevered extension or tab 40*a* (illustrated at the left side of FIG. 6A.) The forming member 30 further includes four downwardly extending bottom panel members 41*a*–41*d* respectively located below the sidewall panel portions 31*a*–31*d*. A plurality of horizontal cuts, generally designated at C1–C5 are formed approximately one fourth of the way up the sidewall panels and intersecting the vertical fold lines 32*a*–32*d* and extending through the oppositely disposed edges 34*a* and 34*b*.

This embodiment of the forming member includes a stress relief feature associated with each of the corners 32*a*–32*d* of the forming member. As the container assembly is filled, causing pressure to be applied to the sidewalls 31*a*–31*d* of the forming member, there is a natural tendency for the upper portion of the forming member to deform to a circular cross-sectional configuration. Such deformation tendency places stress on the forming member sidewalls that is greater in a rectangular container configuration where the corners between sidewalls are at 90° angles. In order to relieve such stress, and to allow for controlled sidewall deformation, the sidewalls are vertically scored adjacent and on either side of the corners 32*a*–32*d*, as indicated by the dashed score lines 50*a*–50*d* in FIG. 6A. Each of the score line pairs vertically extends on either side of a respective corner, in parallel manner, from the upper edge 35 and downwardly to the edges of the cuts C1–C5. It will be noted that the score line pair 50*a* is partially on sidewall 31*a* and partially on 31*d*, since these two sidewalls will be contiguous to one another in the assembled structure. Each pair of the stress relief score lines converge toward one another, in V-shaped manner, slightly below the cuts C1–C5 and meet at the fold line 36 that will represent the bottom of the respective sidewalls. As illustrated in more detail in FIG. 6E, the cuts C1–C5 allow the portions of the sidewalls above the cuts to outwardly deform to a greater extent than that portion of the sidewalls located below the cuts, without placing undue stress to the lower corners of the forming member. FIG. 6E has been illustrated with respect to corner 32*b* and is a view taken from the inside of the forming member corner. The resultant deformation of the forming member 30 allowed during loading of the container, effectively changes the cross-sectional shape of the forming member from a rectangular configuration to a nearly circular twelve-sided configuration.

Figure 6A:
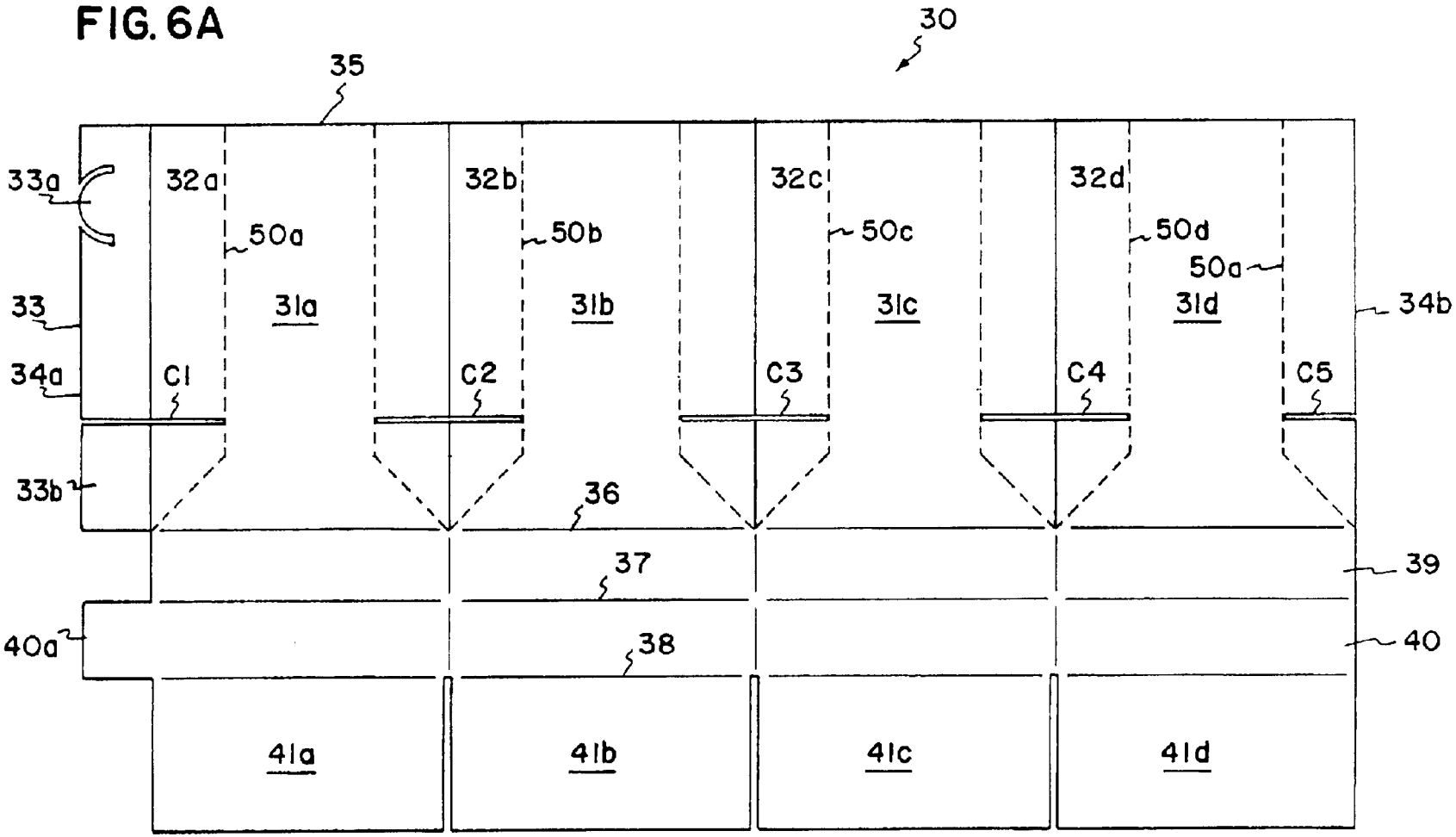
FIG. 6A is a view illustrating on a planar sheet the cut and fold pattern of a third embodiment of a corrugating forming member portion of the container assembly of FIG. 1.
Figure 6D:
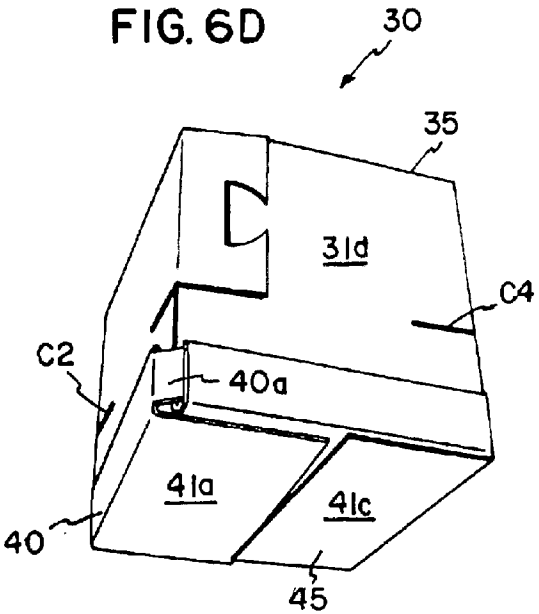
FIGS. 6B–6D illustrate bottom perspective views of the corrugating forming member of FIG. 6A showing progressive stages of folding of its various segments, to derive an operative closed bottom configuration of the third embodiment forming member.
Figure 6C:
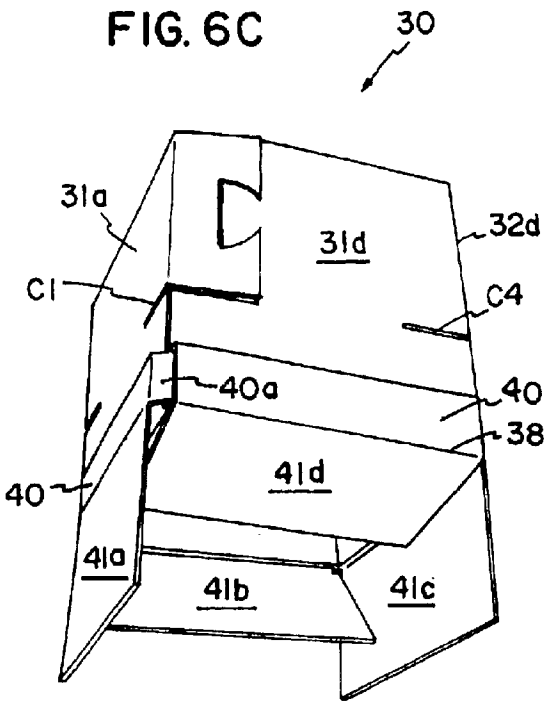
Figure 6B:
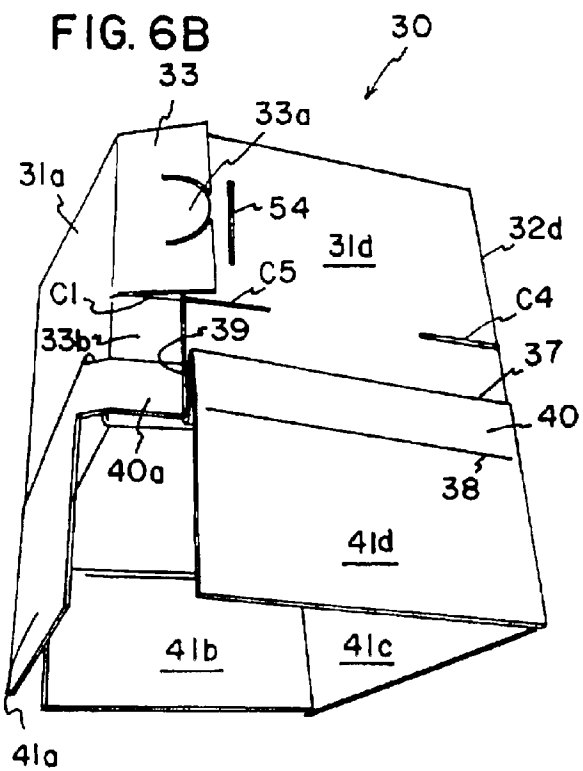
Figure 6E:
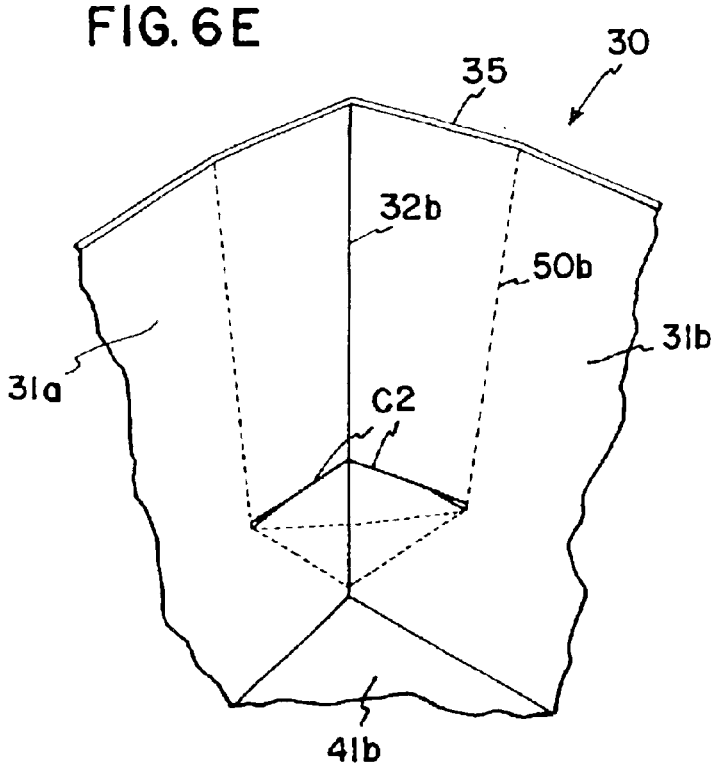
FIG. 6E is a partial top perspective view of an inside upper corner of the third embodiment of the corrugating forming member of FIGS. 6A–6D, illustrating how the corner changes shape along the upper predetermined score lines as pressure is applied to the inner sidewalls of the forming member.

The forming member patterned blank material of FIG. 6A is progressively folded as illustrated in FIGS. 6B–6D, until a box-like rectangular receptacle is configured with bottom 45 as defined, as illustrated in 6D. To form the box-like receptacle configuration, the pattern material illustrated in FIG. 6A is first folded along the fold line 36 such that the horizontal panel 39 and 40 and the lower bottom panels 41 are folded outwardly at an angle of 180° about the fold line 36 and lie in engagement with the sidewall members 31. Next, the pattern is folded along the horizontal fold line 37, such that the bottom tab panels 41 are again disposed in a downwardly depending position and the "inner" surfaces of horizontal panel portions 39 and 40 cooperatively engage one another. The horizontal panels 39 and 40 define a circumferentially extending strengthening band of material around the lower portion of the container, as illustrated in FIGS. 6B–6D. The left most end of the folded panels 39 and 40 (as configured in FIG. 6A) defines a receptor pocket for receiving the tab 40*a* of panel 40. The pattern is then folded along the corner fold lines 32*a*–32*d* to define a box-like internal cavity as illustrated in FIG. 6B such that side edges 34*a* and 34*b* move toward one another, and until the side edge 34*a* engages the slot S4 and the side edge 34*b*. At this position, the tab 40*a* will be slidably received by the pocket formed between panel members 39 and 40, the lower connecting tab 33*b* will slide behind the sidewall 31*d*, and the upper arcuate tab 33*a* will be slidably received by the slot S4. Further movement of the panels will form the configuration illustrated in FIG. 6C. At this stage, the forming member 30 is still foldable on itself, and can be folded into a collapsed position, since the bottom 45 has not yet been formed.

The bottom 45 of the forming member 30 is defined by folding in the lower panel extensions 41 toward the center of the enclosed cavity defined by the connected sidewalls 31. As illustrated in FIGS. 6C and 6D, the lower panels 41*b* and 41*d* are folded in first, followed by lower panels 41*a* and 41*c*. Such bottom configuration 45 defines and locks in the positions of the sidewalls and collectively defines an internal geometric solid shaped cavity having an initial rectangular or square cross-sectional shape. As described above, as bulk material is added to the internal cavity of the forming member, the resultant pressure applied by the bulk material to the sidewalls of the forming member will cause the sidewalls to deform along the score lines 50 adjacent the corners 32 to provide stress relief to the container assembly, while retaining the underlying stability of the container assembly that is provided by the forming member.

While several configurations of forming member have been described with respect to specific preferred embodiments of the invention, those skilled in the art will readily recognize that many other configurations of such forming members can be designed within the scope of this invention. Further, while specific corrugated materials have been described for use in association with constructing the forming members, those skilled in the art will readily recognize that other materials can be employed.

The outer containment sleeve 14 is preferably constructed of the same types of materials, well-known in the art, that are used for making flexible intermediate bulk containers (FIBCs). The sleeve is preferably configured from a flexible woven fiber material, preferably woven polyethylene material which are known for their strength and light weight. Such fabrics come in various weights, which would be selected in accordance with the necessary strength and safety factors required by the container. As with fabrics used in the FIBC industry, the sleeve material could be coated, as for example with polyethylene, or remain breathable, could be treated for ultra violet retardation, could be configured for weather resistance, or could, for example, be of a fabric that complies with the Food and Drug Administration criteria for foods, pharmaceuticals and edibles, and the like. Those skilled in the art will readily recognize these and other options for appropriate materials that could be used for the containment sleeve. The sleeve provides the containment strength of the container system, and must be of a strength suitable for supporting the forces applied by the contained material against the inner surfaces of the forming member sidewalls 12*b*. The sleeve is preferably of tubular and seamless construction, requiring no sewing or stitching. For assembly purposes, the sleeve material could simply be cut to a desired length by a sheer or laser or by a hot knife technique that also conditions the woven material to prevent unraveling thereof. The sleeve 14 is sized to snugly engage and cover virtually the entire outer peripheral surface area of sidewalls. The sleeve 14 extends from the upper edges of the sidewalls 12*b* of the forming member to their lower edges.

Figure 3:
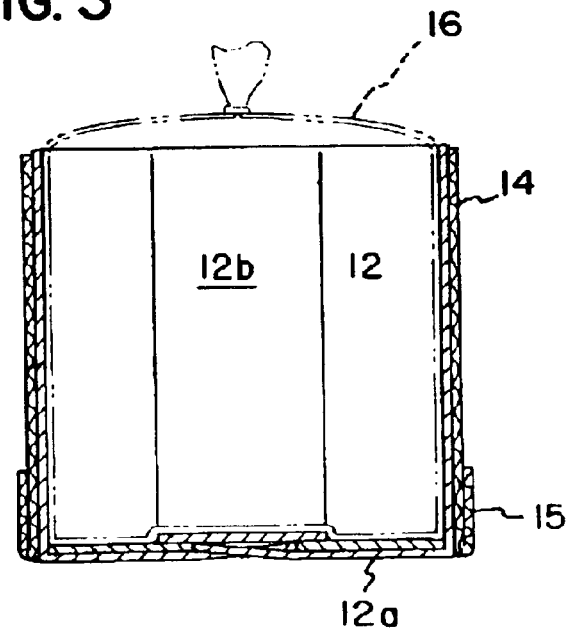
FIG. 3 is a sectional view generally taken along the Line 3—3 of FIG. 2.

In one embodiment of the outer sleeve, as illustrated in FIGS. 1,2, and 3 the length or height of the sleeve 14 is cut longer than the vertical height of the sidewall portions of the forming member 12, such that the lower portion of the sleeve 14 can be folded back upon itself (as illustrated at 15 in FIGS. 1,2, and 3) and extends upwards along the lower portions of the sidewalls to provide additional strength along the surface area portions of the sidewalls, where the pressure caused by weight of the contained material is the greatest. While it can extend along the entire height of the sidewalls, the folded over sleeve portion 15 preferably extends from about 20% to 50% of the height of the sidewalls 12*b*, and more preferably from about 20% to 30% of the height of the sidewalls.

Figure 8:
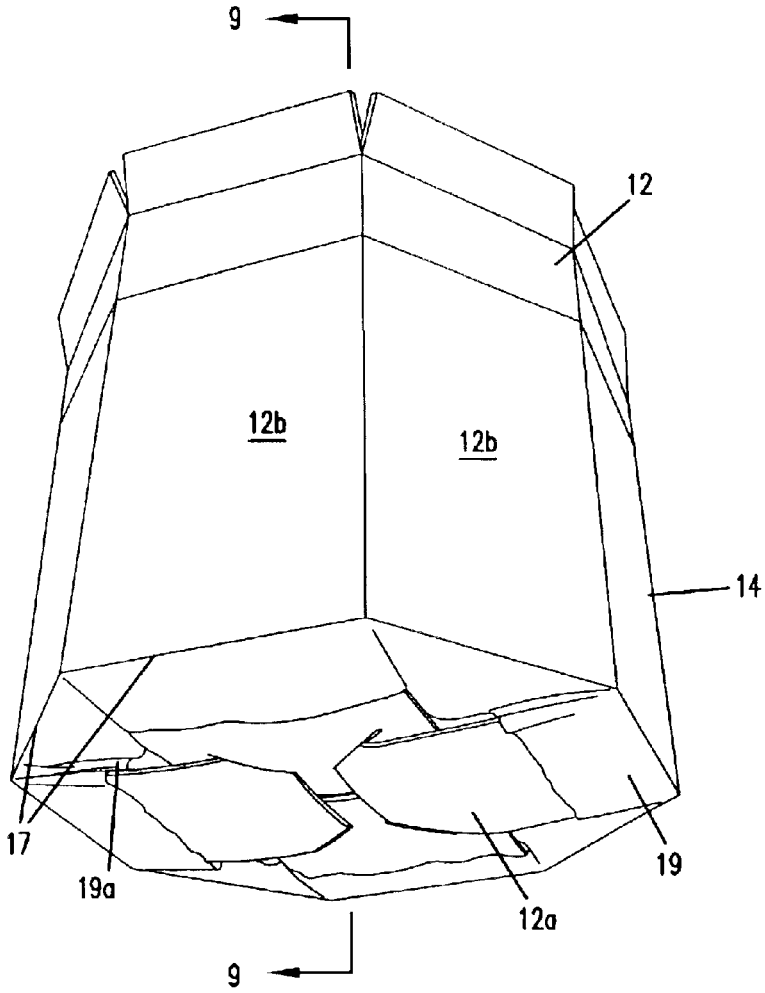
FIG. 8 is a bottom perspective view illustrating how the outer sleeve member may be folded under the forming member and tucked into the gaps formed at the bottom of the forming member when it is fully assembled.
Figure 9:
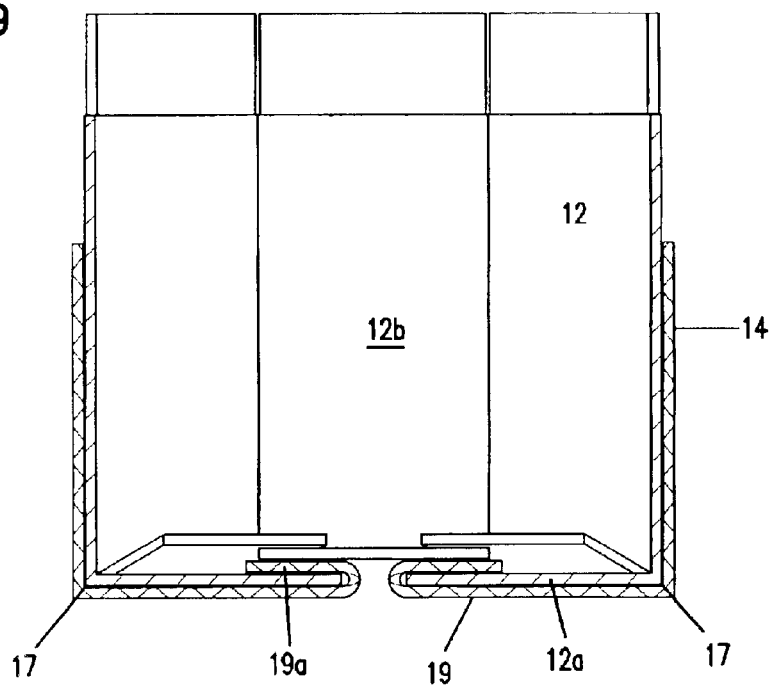
FIG. 9 is a sectional view generally taken along the Line 9—9 of FIG. 8.

In another embodiment of the outer sleeve, the sleeve 14 extends past the lower edges 17 of the sidewalls 12*b* of the forming member and is folded along the lower edges 17 of the sidewalls 12*b* towards the internal cavity formed by the forming member (as illustrated at 19 in FIGS. 8 and 9). Once folded, the folded portion 19 of the sleeve may be tucked into the gaps formed at the bottom of the forming member when it is fully assembled (as illustrated at 19*a*). Liquids and semi-liquids, such as meat, have a high tendency to flow during shipment. Such movement increases the pressure against the sidewalls of the forming member that the flow and movement are directed against. Tucking the sleeve under the forming member in this manner counteracts the increased pressure and provides extra strength to the container system. It also provides stability to the sleeve member and prevents unwanted movement of the sleeve member, such as rising up of the sleeve along the sidewalls 12*b*. The weight of the container content when loaded into it holds the tucked sleeve member 19*a* in place during shipment. Since the sleeve 14 does not have a closed bottom as is the case with an FIBC, significant manufacturing costs are saved as compared to the FIBC manufacturing process, by eliminating all stitching and sewing operations.

Figure 10:
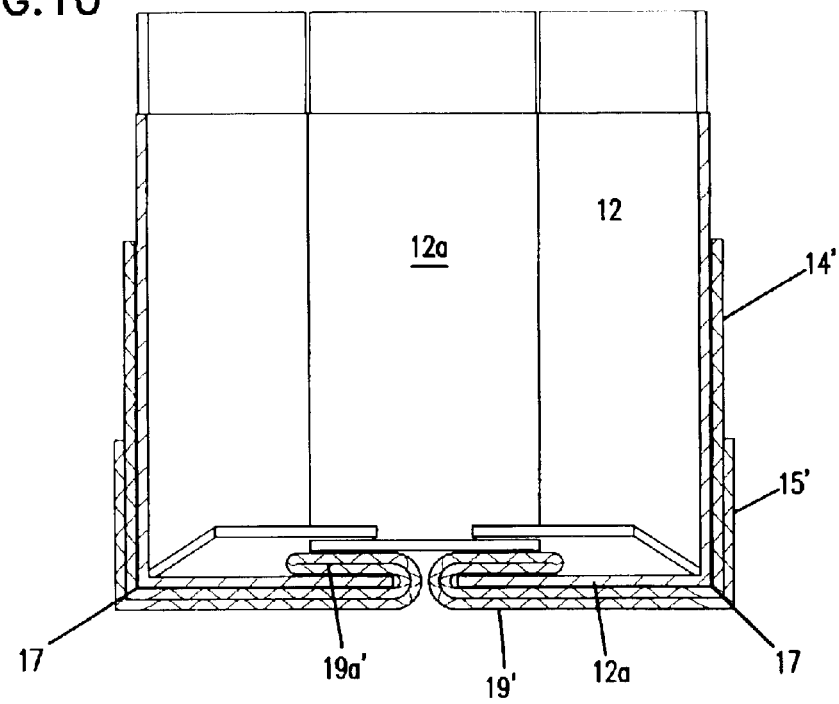
FIG. 10 is a sectional view similar to that of FIG. 9 illustrating a first method of folding the sleeve material against itself before folding the sleeve under the forming member.

In yet another embodiment of the outer sleeve 14', as illustrated in FIG. 10, the length or height of the sleeve 14' may be cut longer than the vertical height of the sidewall portions 12*b* of the forming member 12, such that the lower portion of the sleeve can be folded back upon itself (as illustrated at 15') after being folded along the lower edges 17 of the sidewalls 12*b* towards the center of the bottom 12*a* of the forming member 12 (as illustrated at 19'). The sleeve portion remaining past the lower edges 17 of the sidewalls 12*b* is tucked into the gaps formed at the bottom of the forming member when it is fully assembled, as mentioned above, to provide strength, stability and prevent unwanted movement (as illustrated at 19*a'*). The folded up sleeve portion 15' preferably extends from about 20% to 50% of the height of the sidewalls 12*b*, and more preferably from about 20% to 30% of the height of the sidewalls. This configuration provides a double layer of sleeve material that extends upwards along the lower portions of the sidewalls to provide additional strength to the surfaces of the sidewalls.

Figure 11:
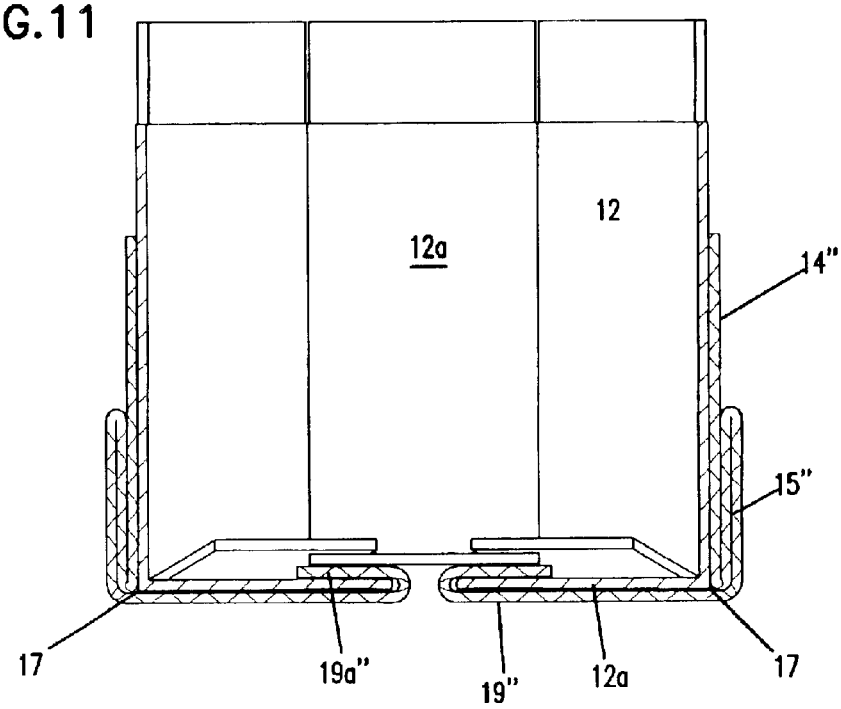
FIG. 11 is a sectional view similar to that of FIG. 9 illustrating a second method of folding the sleeve material against itself before folding the sleeve under the forming member.

In yet another embodiment of the outer sleeve 14", as illustrated in FIG. 11, the lower portion of the sleeve can be folded back upon itself first (as illustrated at 15") and then folded back down upon itself and folded at the lower edges 17 of the sidewalls 12*b* towards the center of the bottom of the forming member (as illustrated at 19"). Once folded, the folded portion 19" of the sleeve may be tucked into the gaps formed at the bottom of the forming member when it is fully assembled, as mentioned above, to provide strength, stability to the sleeve member and prevent unwanted movement (as illustrated at 19*a"*). The folded up sleeve portion 15" preferably extends from about 20% to 50% of the height of the sidewalls 12*b*, and more preferably from about 20% to 30% of the height of the sidewalls. This configuration provides a triple layer of sleeve material that extends upwards along the lower portions of the sidewalls to provide additional strength along the bottom surface area portions of the sidewalls, where the pressure caused by weight of the contained material is the greatest.

Those skilled in the art can envision yet other methods for selectively increasing the strength of the outer sleeve by using folding techniques. Alternatively and/or additionally, extra layers of outer sleeve 14 may be used around the forming member 12 to provide additional strength. Each layer may be non-folded or folded according to any of the embodiments discussed above depending upon the intended use of the container system and the additional strength needed.

The woven tubular material forming the outer sleeve 14 can be readily purchased from any supplier of FIBCs such as from B.A.G. Corp. of Dallas, Tex. or from other distributors or suppliers such as Tech Packaging Group of Joplin, Mo. or National Paperboard Group, Inc. of Burnsville, Minn. The woven polypropylene tubular sleeve material is typically graded by weight. A preferred weight of material that is acceptable for most applications is a 5.2 oz. weight. The liner bags 16 can be purchased generally from the same suppliers that supply the FIBCs.

Lighter weight materials can be used for the outer sleeve of this invention as compared with FIBC applications, since the sleeve only needs to support horizontally applied containment forces. It should be noted that the maximum bulk material handling weight specifications for materials used in constructing FIBCs do not generally apply to this invention, since the weakest feature of FIBC construction relates to the stitching used in the FIBC bag construction. Generally, the stitching of a FIBC will fail long before the woven fabric. Since there is no stitching required for the sleeve of the present invention, this invention takes full advantage of the base strength of the woven material, enabling the use of relatively lighter weight materials for containing relatively heavy parcels of contained materials. Further, due to its woven construction, small holes or the like that may be imparted to the sleeve fabric during use will generally not result in catastrophic failure or unraveling or rupture of the sleeve that would reduce its containment strength as used in this invention. Also, if the woven polypropylene sleeve material is coated with polyethylene, the unraveling of the polypropylene material is generally prevented by the coating.

Figure 12:
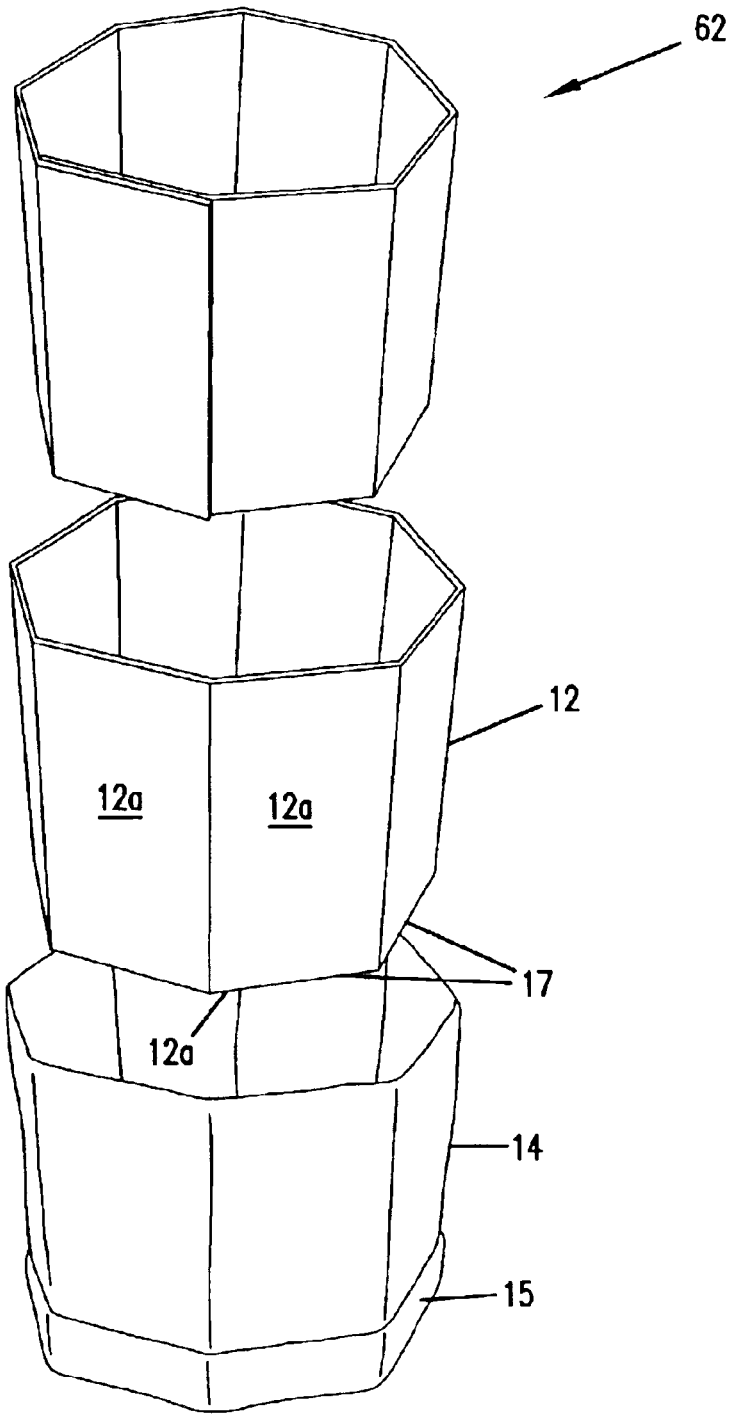
FIG. 12 is an exploded perspective view of a bulk material container assembly containing an outer sleeve, a forming member, and a one-piece insert.

Referring to FIG. 12, an inner insert 62 may be used to provide additional strength to the containment system. Inner insert 62 may be comprised of one, two, three or more pieces, depending upon the intended use of the container system and the additional strength needed. When operatively configured within the container system, the insert engages the inner peripheral sidewall areas 12*b* of the forming member to provide additional strength. The insert 62 is sized to fit within the internal cavity defined by the forming member. The difference in the circumference of the insert 62 and the circumference of the forming member 12 allows the volume of the loaded material to expand within the container system without splitting or bursting the sidewalls 12*b* of the forming member 12. Use of an insert 62, may permit the forming member 12 to be glued if desired, to provide more rigidity. In a one-piece insert (as illustrated at 62 in FIGS. 12, 15, and 17, the insert can be configured of a relatively lightweight corrugated material (as illustrated at 62 in FIGS. 12 and 17), such as the material used for the forming member 12, or it can be constructed of the same type of materials that are used for the outer sleeve 14 (as illustrated at 62 in FIG. 15). Also, the thickness and strength of the corrugated materials used for the forming member 12 may be significantly reduced as a result of the insert 62 providing the additional strength. The insert 62 is an important feature of the invention that adds an additional expansion feature, enables the forming member 12 to be glued for increased rigidity for stacking, and adds overall strength and rigidity to the overall container system. The insert itself, however, generally does not have glued sidewall joints.

Figure 13:
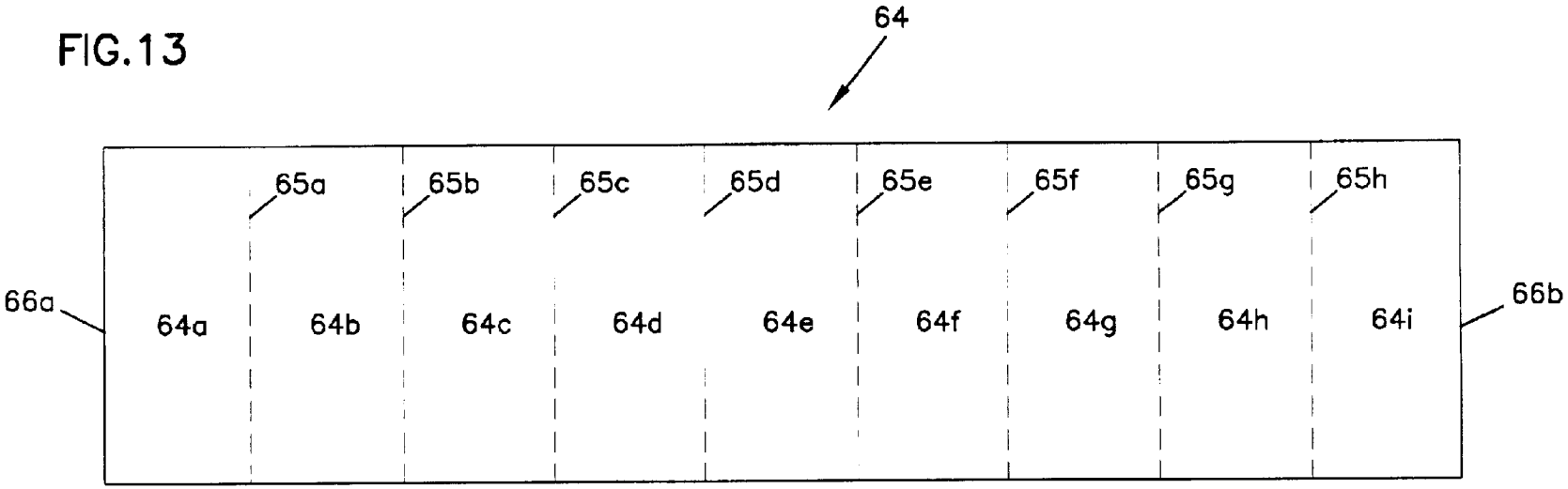
FIG. 13 is a view illustrating on a planar sheet the cut and fold pattern of a first embodiment of a corrugated one-piece insert portion of the container assembly of FIG. 12.

A first embodiment of a one-piece insert, constructed from corrugated cellulose (cardboard) material, is illustrated at 64 in FIG. 13. In this embodiment, the one-piece insert 64 is configured from a single piece of corrugated material that is scored and patterned for folding, as illustrated in FIG. 13. Referring thereto, the insert 64 has nine sidewall portions 64*a*–64*i* consecutively connected and defined by intervening fold lines 65*a*–65*h* respectively, which collectively define the eight "corners" of an octagonally shaped configuration formed by the insert. The insert patterned blank material of FIG. 13 is folded along the scored lines 65*a*–65*h* until an octagonal tubular insert is configured. Sidewall 64*a* will overlap sidewall 64*i*, resulting in an eight-faced insert. To form the octagonal insert, the material illustrated in the FIG. 13 pattern is folded along the scored lines 65*a*–65*h* so that side edges 66*a* and 66*b* move toward one another and until the sidewall 64*a* overlays sidewall 64*i*. At this stage, the one-piece insert would appear as illustrated at 62 in FIG. 12. At this point, the structure is still foldable upon itself and can be folded into a collapsed position. Sidewall 64*a* would be freely slidable over sidewall 64*i* in this embodiment. The insert would mainly be providing the container system with a second layer of corrugated material for extra strength and rigidity for stacking purposes.

Figure 14:
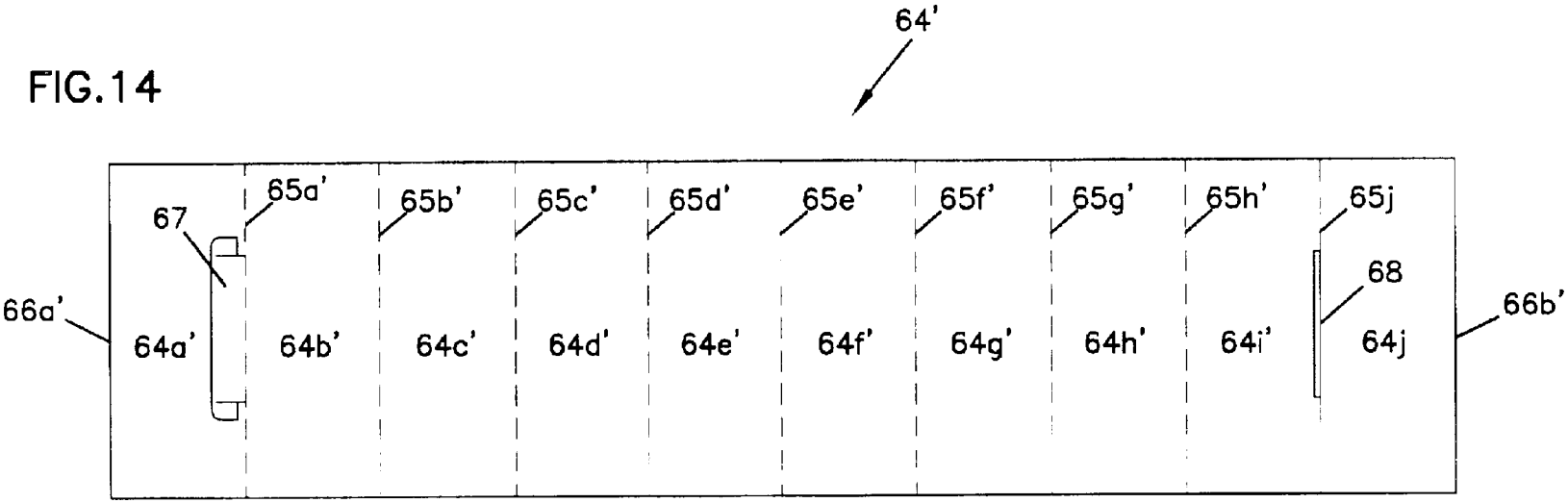
FIG. 14 is a view illustrating on a planar sheet the cut and fold pattern of a second embodiment of a corrugated one-piece insert portion of the container assembly of FIG. 12.

A second embodiment of the one-piece insert, constructed from corrugated cellulose (cardboard) material, is illustrated at 64" in FIG. 14. In this embodiment, the one-piece insert is configured from a single piece of corrugated material that is scored and patterned for folding, as illustrated in FIG. 14. Referring thereto, the insert 64' has ten sidewall portions 64*a*'–64*j* consecutively connected and defined by intervening fold lines 65*a*'–65*j* respectively, which eventually define the eight "corners" of the insert. The insert patterned blank material of FIG. 14 is folded along the scored lines 65*a*'–65*j* until an octagonal tubular insert is configured. To form the octagonal insert, the material illustrated in the FIG. 14 pattern is folded along the scored lines 65*a*'–65*j* so that side edges 66*a*' and 66*b*' move toward one another. Tab member 67, when the material is folded, will remain on the inner side of the formed octagonal tubular insert. Tab member 67 is slidably received within slot 68. In this position, the sidewall 64*i*' overlies sidewall 64*a*' and sidewall 64*j* overlies sidewall 64*b*'. At this stage, the one-piece insert would appear as illustrated at 62 in FIG. 12. At this point, the structure is still foldable upon itself and can be folded into a collapsed position. It will be noted that the tab member 67 is slidably within the slot 68. Such sliding construction provides for limited relative movement of the sidewall configuration to accommodate expansion and contraction of the material being contained by the container assembly.

The inserts 64 and 64' described above did not have any "bottoms". However, a third embodiment of the one-piece insert, constructed from corrugated cellulose (cardboard) material, which does have a bottom structure, is illustrated at 20 in FIG. 4A. In this configuration, the embodiment of the forming member, previously described and illustrated at 20 in FIGS. 4A–4D, is used as the one-piece insert, which is placed within an outer forming member 12. When so used, the insert is sized smaller than the outer forming member in order to fit within the forming member 12. This embodiment is configured and folded according to the directions given above for the embodiment of the forming member illustrated at 20 in FIGS. 4A–4D.

The one-piece insert configurations described above are by no means exhaustive of the configurations that are possible. Depending upon the forming member configuration utilized, the insert should be accordingly shaped and configured to fit within the forming member. While several configurations of the one-piece insert have been described with respect to specified preferred embodiments of the invention, those skilled in the art will readily recognize that many other configurations of such inserts can be designed within the scope of the invention. Further, while specific corrugated materials have been described for use in association with constructing the forming members, those skilled in the art will readily recognize that other materials can be employed.

Figure 16:
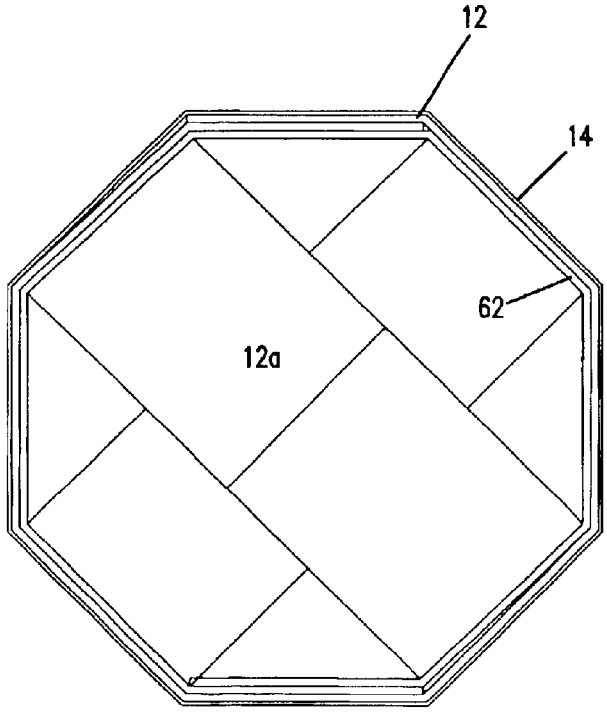
FIG. 16 is a top view of an assembled bulk material container assembly of the type illustrated in FIG. 12, containing an outer sleeve, a forming member, and a one-piece insert constructed of corrugated material, where the insert is sized slightly smaller in circumference than the forming member to fit snugly into the forming member.
Figure 17:
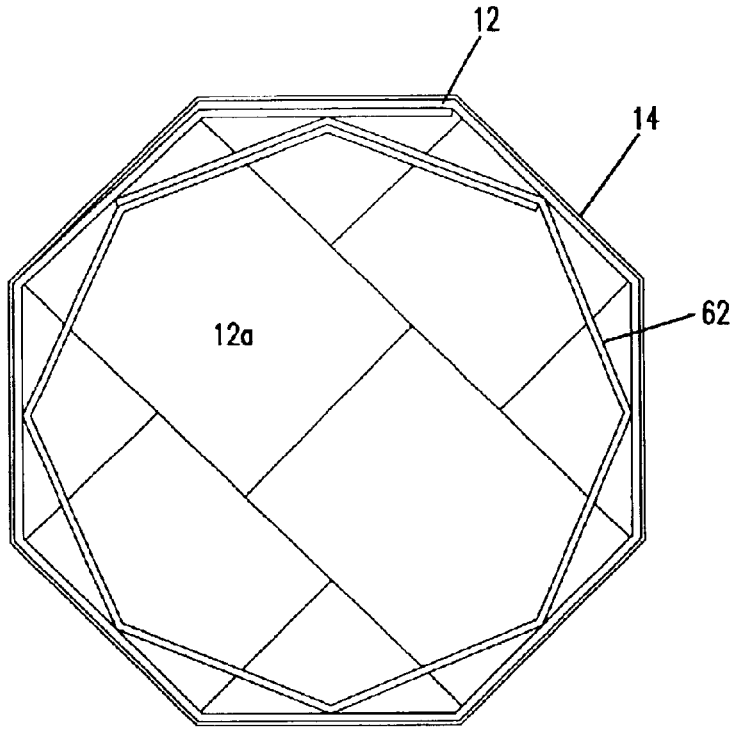
FIG. 17 is a top view of an assembled bulk material container assembly of the type illustrated in FIG. 12, containing an outer sleeve, a forming member, and a one-piece insert constructed of corrugated material, where the insert, having a substantially smaller circumference than the forming member, is placed in an offset fashion.

Once configured, the one-piece insert is placed within the forming member 12 to engage the inner peripheral sidewall areas of the forming member. The one-piece insert is preferably sized in order to snugly engage the inner peripheral sidewall areas of the forming member so that, when bulk material is being poured inside the cavity formed by the forming member, the insert does not slide up along the inner sidewall areas 12*b* of the forming member 12, as illustrated in FIG. 16. The insert 62 may also be placed in an offset fashion within the forming member 12, where each corner of the insert defined by the sidewalls of the insert engages each of the inner sidewalls 12*b* of the forming member generally along a vertical centerline of the forming member sidewalls, as illustrated in FIG. 17. This offset configuration (FIG. 17), providing a tight fit, prevents unwanted movement of the insert 62 inside the forming member 12 that might tend to collapse the insert prior to the container loading or filling operation. Also, offsetting the insert 62 in this manner provides additional strength to the container assembly by distributing the stress on the sidewalls 12*b* of the forming member 12 and the insert 62 instead of placing it all at the weaker fold lines. Typically, an oversized liner 16 is used with the container system. The upper portion of the liner is folded over the top edges of the forming member and insert(s) and down along the outside surfaces of the forming member sidewalls, such that the liner material overlays and "covers" the gaps or spaces between the insert and forming member sidewalls (see FIGS. 17 and 19), so that the material being loaded into the container does not fall within such gaps or spaces during the loading operation. The insert sidewalls are thus freely allowed to expand outwardly toward and into engagement with the forming member sidewalls during the loading operation.

Figure 15:
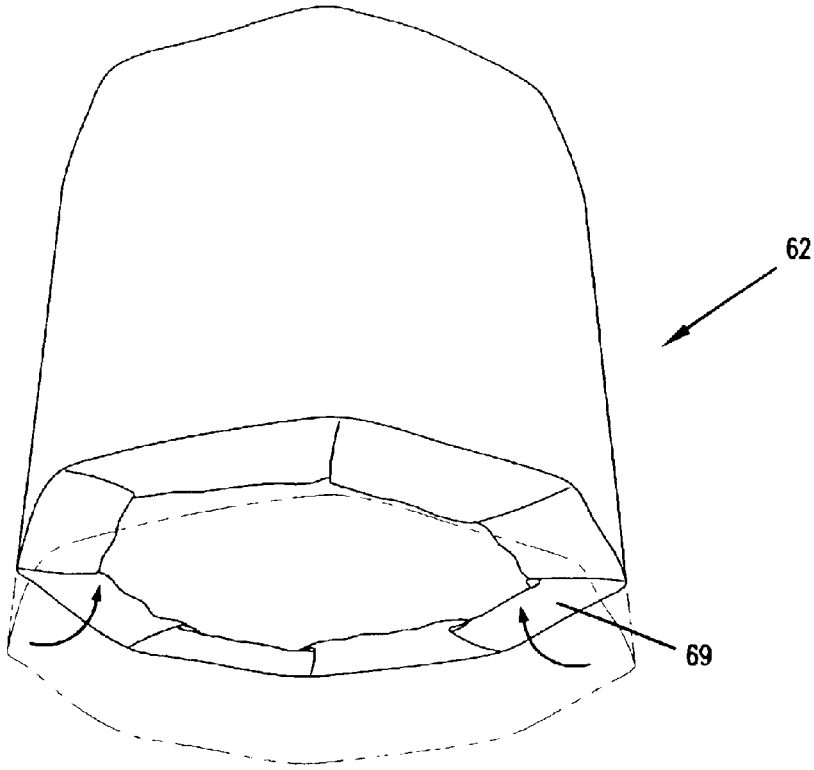
FIG. 15 is a perspective view of an embodiment of a one-piece insert constructed of woven polypropylene material.

In a one-piece insert, the insert can also be of the same type of materials that are used for the outer sleeve 14. For assembly purposes, the sleeve material could simply be cut to a desired length by, for example, any of the techniques previously discussed. The sleeve material one-piece insert is sized to be placed inside the forming member to provide an additional layer of strength. The sleeve material one-piece insert may be folded in any of the combination of ways discussed above for the outer sleeve member, when placed inside the forming member depending upon the intended use and the needed strength of the containment system. Folding the lower edge of the insert sleeve material towards the inside, as illustrated at 69 in FIG. 15, provides the advantage of preventing unwanted upward movement of the insert sleeve. When bulk material is being poured into the containment system, the bulk material weighs down the folded-in extended portions 69 of the inner sleeve, preventing the entire sleeve from rising up along the surfaces of the inner sidewalls 12*b* of the forming member 12.

Figure 19:
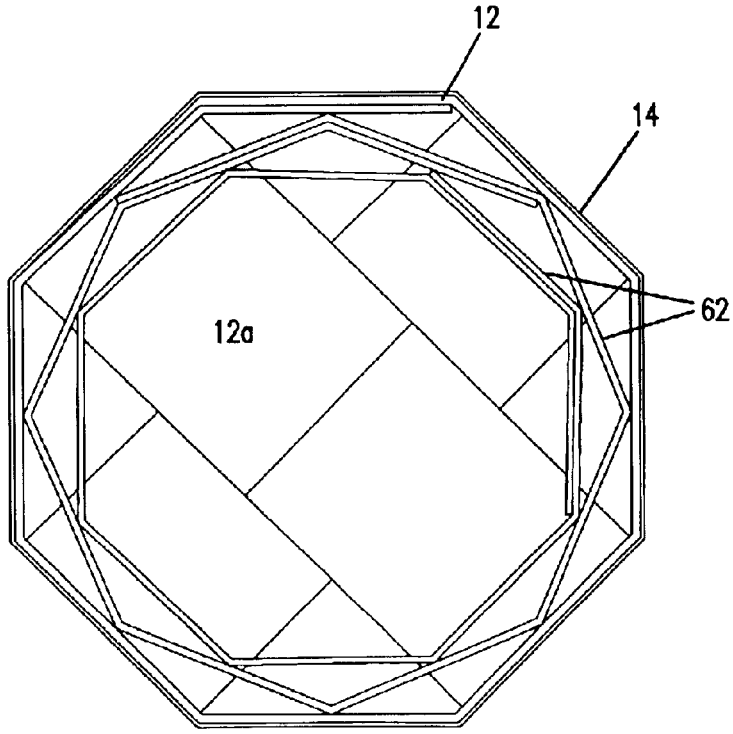
FIG. 19 is a top view of a bulk material container assembly containing an outer sleeve, a forming member, and a two-piece insert, where both of the insert pieces are constructed of corrugated material and are placed in an offset fashion relative to each other.
Figure 18:
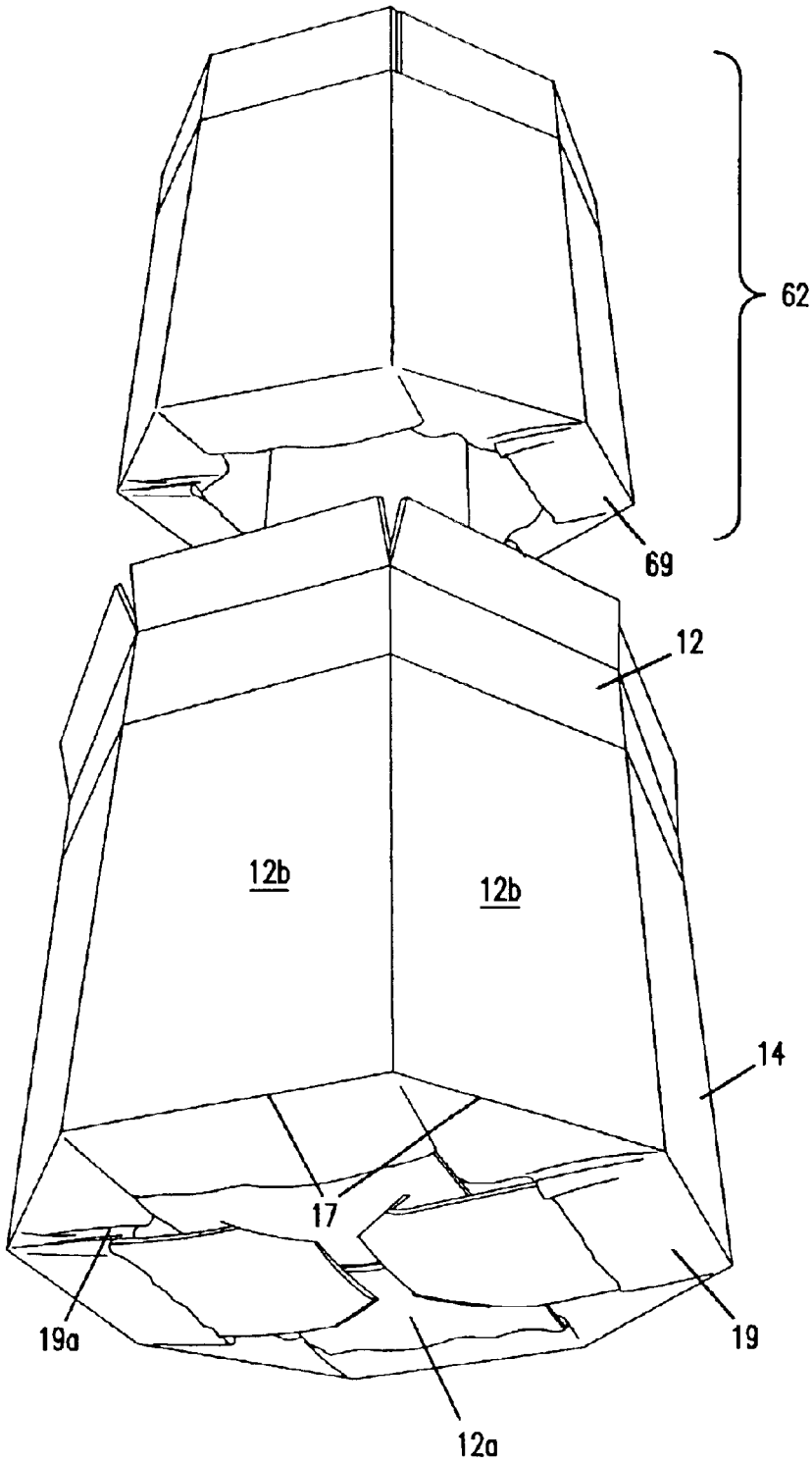
FIG. 18 is an exploded perspective view of a bulk material container assembly containing an outer sleeve, a forming member, and a two-piece insert, where the outer piece of the two-piece insert is constructed of woven polypropylene material and the inner piece is constructed of corrugated material.
Figure 20:
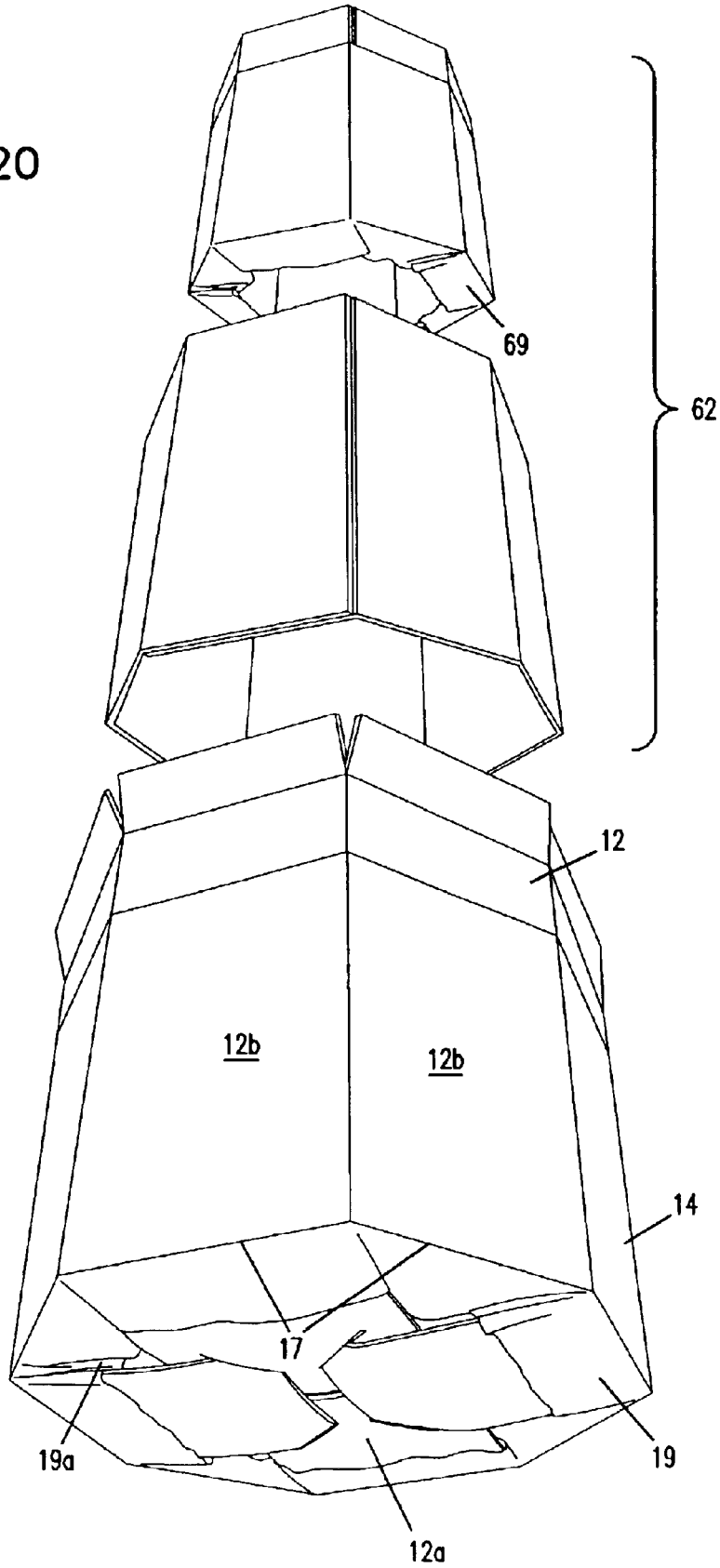
FIG. 20 is an exploded perspective view of a bulk material container assembly containing an outer sleeve, a forming member, and a three-piece insert, where the outermost piece of the three-piece insert is constructed of corrugated material, the middle piece is of woven polypropylene material, and the innermost piece is constructed of corrugated material.

The insert may also be constructed of at least two pieces, the pieces being configured of any combination of the materials or the shapes discussed above for the one-piece insert (as illustrated at 62 in FIGS. 18, 19, and 20. The two-piece insert may utilize either the relatively lightweight corrugated material, such as the material used for the forming member 12, or it can be constructed of the same type of materials that are used for the outer sleeve 14, or the two-piece insert may utilize a combination of the two types of materials (as illustrated at 62 in FIG. 18). The outer piece of the two-piece insert is sized and shaped to slidably engage the surfaces of the inner sidewalls 12*b* of the forming member 12, while the inner piece of the two-piece insert is sized and shaped to engage the inner surface of the outer piece. Either pieces of the two-piece insert, if of corrugated material, may be placed in an offset fashion, as discussed above, to prevent unwanted movement of the pieces and to increase strength by distributing the stress on the sidewalls. A configuration showing both of the pieces of the two-piece insert being placed in an offset fashion relative to each other is shown in FIG. 19. In a configuration where the outer insert piece of the two-piece insert is of woven polypropylene (sleeve material), the outer piece may be folded in a variety of ways as discussed above for the outer sleeve. In a configuration, such as the one seen at 62 in FIG. 18, the lower edge of the sleeve material of the two-piece insert being folded under the inner corrugated piece provides the advantage of preventing the inner corrugated piece from moving during the loading of bulk material. This is possible because, as discussed above, the bulk material weighs the folded-in extended portions 69 of the sleeve material down, and since the sleeve material of the insert is sized to fit snugly around the inner corrugated piece of the insert, the corrugated piece is also held down.

Depending on the intended use of the containment system or the strength needed, three or more pieces can be utilized to make up the inner insert, being configured of any of the combination of the materials and the shapes, discussed above, of the one-piece insert (as illustrated at 62 in FIG. 20). The optional bag/liner, illustrated at 16 in FIGS. 1, 2, and 3, may be of any appropriate film or sheet of flexible impervious material, preferably polyethylene or polypropylene, to protect the contents of the container system and/or to prevent leakage of liquids or sifting of powders out of the forming member insert. Such liners are well-known in the art and have been used in the past for both corrugated and FIBC packaging. The bag/liner 16 could include a filling spout and sealing mechanism at its upper end, as well as a discharge spout at its lower end. Such discharge spout would operatively extend through a hole or opening (not illustrated) in the sidewalls of the forming member and insert member(s) as well as through the outer sleeve material, for enabling emptying of the contents from the liner. The bag/liner 16 could also be made just thin enough to provide an impervious inner coating or layer to the forming member 12. Often, wherein the contents of the shipping container are pumped out of the container during removal, the bag/liner need only be strong enough to allow lifting of any residual product left in the bag/liner following the pumping operation, in order to remove and reclaim the residual materials. Similar to the sleeve material 14 used with the forming member 12 or the insert 62, the bag/liners are flexible and collapsible and can be recycled, making the entire container system a collapsible and recyclable system.

In a preferred configuration of the invention as used for carrying a 2000-lb. load of liquids or semi-liquids such as meat, the following container system parameters have been found to provide safe and successful performance: an elongated octagonal outer forming member of 350 lb. weight and of double-wall flute corrugation; an outer sleeve of 5.2 oz. polycoated polypropylene having an operative circumference of 144 inches (stretches about 1 inch) and extending beyond the lower edge of the sidewalls of the forming member by approximately 8 inches.

In a preferred configuration of the invention as used for carrying a 1200–1400-lb. load of semi-solids such as resin, the following container system parameters have been found to provide safe and successful performance: a regular octagonal outer forming member of 350 to 500 lb. double wall corrugated material; an outer sleeve of 5.2 oz. polycoated polypropylene having an operative circumference of 144 inches (stretches about 1 inch) and extending beyond the lower edge of the sidewalls of the forming member by approximately 8 inches; and an inner sleeve insert (placed around a corrugated insert of 275 lb. C-flute material) of 5.2 oz. coated polypropylene having an operative circumference of 142 inches (stretches about 1 inch).

In a preferred configuration of the invention as used for carrying a 3000-lb. load of solids such as sugar, the following container system parameters have been found to provide safe and successful performance: a regular octagonal outer forming member of 500 lb. weight and of double-wall flute corrugation; an outer folded sleeve of 5.2 oz. polycoated polypropylene having an operative circumference of 144 inches (stretches about 1 inch) and extending beyond the lower edge of the sidewalls of the forming member by approximately 8 inches; and an inner sleeve insert (placed around a corrugated insert) of 5.2 oz. coated polypropylene having an operative circumference of 142 inches (stretches about 1 inch).

Figure 7:
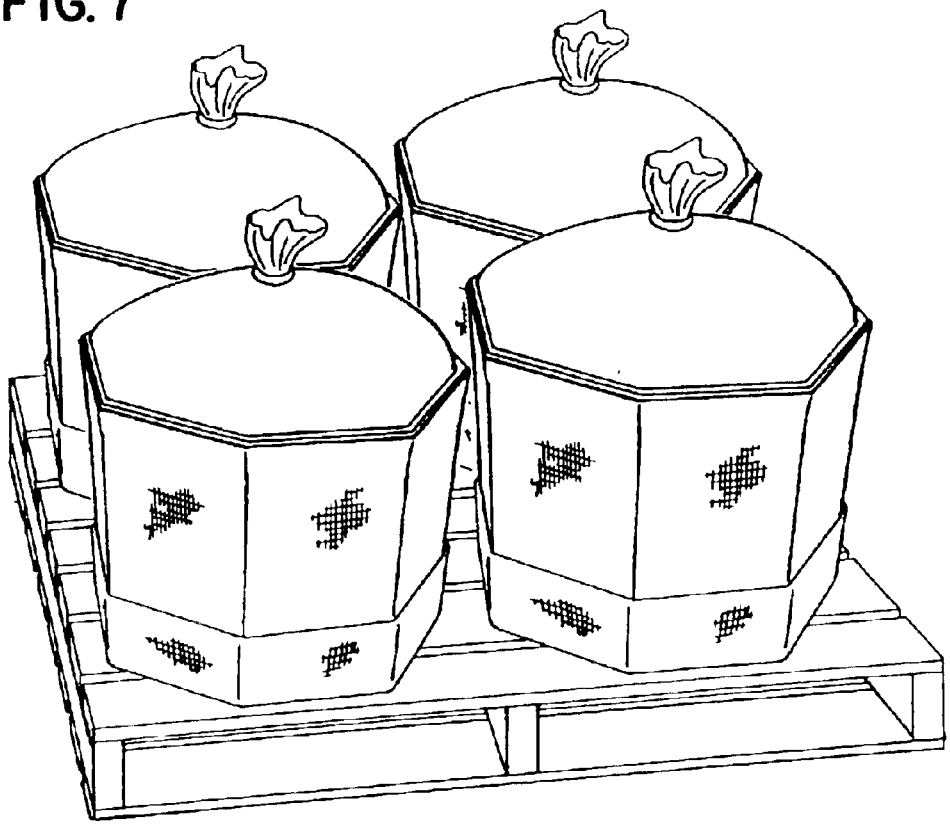
FIG. 7 is a diagrammatic perspective view illustrating a plurality of the bulk material containers of the present invention cooperatively positioned on a pallet.

FIG. 7 illustrates the fact that the container apparatus of the present invention can be employed in situations wherein multiple such container assemblies are supported by a single pallet. While the container assemblies of FIG. 7 have been illustrated as being separated from one another, they could equally well have been positioned so as to engage one another for forming a more stabilized pallet block of such container assemblies.

The above specification, examples and data provide a complete description of the manufacture and use of the composition of the invention. Since many embodiments of the invention can be made without departing from the spirit and scope of the invention, the invention resides in the claims hereinafter appended

We claim:

1. A container for bulk materials comprising:

(a) a forming member, comprising:

(i) a plurality of sidewalls extending between upper and lower edges and interconnected to cooperatively form an outer surface and to encircle an internal cavity for receiving bulk materials; and (ii) a locking assembly cooperatively engaging the sidewalls to define and fix predetermined relative positions thereamong; and (b) a sleeve with opposed open ends, the sleeve made of continuous, woven material sized to snugly engage and to overlie substantially the entire said outer surface of said sidewalls between said upper and lower edges, wherein said sleeve is configured with a fold extending from the lower edges of the sidewalls towards said internal cavity.

2. The container as recited in claim 1, wherein said forming member comprises a single piece of material.

3. The container as recited in claim 1, wherein said sidewalls comprise corrugated material.

4. The container as recited in claim 1, wherein said forming member is collapsible when said locking assembly is not operable to fix the positions of said sidewalls.

5. The container as recited in claim 1, wherein said locking assembly engages said sidewalls along said lower edges.

6. The container as recited in claim 1, wherein said sleeve can be operatively positioned overlying said forming member by sliding the sleeve over the sidewalls, from either their said upper or lower edges.

7. The container as recited in claim 1, wherein said sleeve is tubular in shape and of substantially the same cross-sectional dimension across its entire length.

8. The container as recited in claim 7, wherein said sleeve comprises polypropylane material.

9. The container as recited in claim 1, wherein said sleeve is further folded back upon itself adjacent said lower edge of the sidewalls to provide additional strength to said sleeve.

10. The container as recited in claim 1, wherein said sidewalls include foldable tabs alongside some of said upper edges of said sidewalls of said forming member for enhancing stacking of containers upon each other.

11. The container as recited in claim 1, wherein at least two of said sidewalls are configured to slidably engage one another to provide for limited relative movement thereof.

12. The container as recited in claim 1, wherein at least two of said sidewalls are glued to each other.

13. The container as recited in claim 12, wherein said glue is of a releasable type that allows said glued sidewalls to slidably move relative to one another when subjected to predetermined sheer forces.

14. The container as recited in claim 1, further including a liner of impervious material, sized and configured for placement within said internal cavity.

15. The container as recited in claim 1, wherein said lower edges of the sidewalls are configured to lie adjacent to and supported by an upper surface of a pallet.

16. A rigid container for bulk materials comprising:

(a) a forming member defining un outer side surface and encircling an internal cavity for receiving bulk materials which extend outward radial forces on the side surface; and (b) a flexible sleeve with opposed open ends and made of continuous material, the sleeve configured to engage substantially the entire outer side surface of the forming member;

(c) wherein the sleeve configured to support a majority of the radial forces exerted by bulk materials contained within the container, wherein, as compared to that provided by the sleeve, the forming member is configured to provide a majority of the rigidity of the container, wherein the outer side surface defines upper and lower edges and wherein the sleeve is configured with a fold extending from the lower edge of the side surface towards the internal cavity.

17. A container for bulk materials comprising:

(a) a forming member, comprising:

(i) a plurality of sidewalls extending between upper and lower edges and interconnected to cooperatively form an outer surface and to encircle an internal cavity for receiving bulk materials; and (ii) a locking assembly cooperatively engaging the sidewalls to define and fix predetermined relative positions thereamong;

(b) a sleeve with opposed open ends, the sleeve made of continuous, woven material sized to snugly, slidably engage and to overlie substantially the entire said outer surface of said sidewalls between said upper and lower edges, wherein said sleeve is configured to retain the upright shape of said forming member outer surface as bulk materials are loaded into said internal cavity; and (c) an insert member sized and configured for placement within said internal cavity.

18. The container as recited in claim 17, wherein said insert member comprises corrugated material.

19. The container as recited in claim 17, wherein said insert member comprises a plurality of sidewalls extending between upper and lower edges and slidably interconnected to cooperatively encircle an internal cavity for receiving bulk materials.

20. The container as recited in claim 19, wherein said insert member comprises a locking assembly cooperatively engaging the sidewalls of said insert member to define and fix predetermined positions of the sidewalls of said insert member relative to one another, while permitting limited movement of said sidewalls of said insert member relative to each other and to said locking assembly.

21. The container as recited in claim 20, wherein said insert member is collapsible when said locking assembly is not operable to fix the positions of said sidewalls of the insert member.

22. The container as recited in claim 20, wherein said locking assembly engages said sidewalls generally along said lower edges of the insert member.

23. The container as recited in claim 22, wherein said locking assembly forms a bottom of the insert member and extends across the internal cavity.

24. The container as recited in claim 17, wherein said insert member comprises continuous, woven material.

25. The container as recited in claim 17, wherein said insert member is slidably disposed relative to said forming member.

26. The container as recited in claim 24, wherein said insert member is tubular in shape and of substantially the same cross-sectional dimension across its entire length.

27. The container as recited in claim 26, wherein said insert member comprises polypropylene material.

28. The container as recited in claim 17, wherein at least two of said sidewalls of said forming member are configured to slidably engage one another to provide for limited relative movement thereof.

29. The container as recited in claim 17, wherein at least two of said sidewalls of said forming member are glued to each other.

30. The container as recited in claim 29, wherein said glued sidewalls are glued by a releasable glue that enables said glued sidewalls to slide relative to one another.

31. The container as recited in claim 17, further including a liner of impervious material, sized and configured for placement within said insert.

32. The container as recited in claim 17, wherein said sleeve can be operatively positioned overlying said forming member by sliding the sleeve over the sidewalls, from either their said upper or lower edges.

33. The container as recited in claim 17, wherein said sleeve is tubular in shape and of substantially the same cross-sectional dimension across its entire length.

34. The container as recited in claim 17, wherein said sleeve comprises polypropylene material.

35. The container as recited in claim 17, wherein said sleeve is configured with a fold extending upward from the lower edges of the sidewalls to provide double strength resistance to forces directed outwardly from the internal cavity.

36. The container as recited in claim 17, wherein said sleeve is configured with a fold extending from the lower edges of the sidewalls towards said internal cavity to provide strength resistance to forces directed outwardly and downwardly from the internal cavity.

37. The container as recited in claim 36, wherein said sleeve is further folded back upon itself adjacent said lower edge of the sidewalls to provide additional strength to said sleeve adjacent the lower edge.

38. A container for bulk materials comprising:

(a) a forming member, comprising:

(i) a plurality of sidewalls extending between upper and lower edges and interconnected to cooperatively form an outer surface and to encircle an internal cavity for receiving bulk materials; and (ii) a locking assembly cooperatively engaging the sidewalls to define and fix predetermined relative positions thereamong; and (b) a sleeve of continuous, woven material sized to snugly engage and to overlie substantially the entire said outer surface of said sidewalls between said upper and lower edges, wherein said sleeve is configured with a fold extending from the lower edges of the sidewalls towards said internal cavity and wherein said sleeve is further folded back upon itself adjacent said lower edge of the sidewalls to provide additional strength to said sleeve.

39. A container for bulk materials comprising;

(a) a forming member, comprising:

(i) a plurality of sidewalls extending between upper and lower edges and interconnected to cooperatively form an outer surface and to encircle an internal cavity for receiving bulk materials; and (ii) a locking assembly cooperatively engaging the sidewalls to define and fix predetermined relative positions thereamong;

(b) a sleeve of continuous material sized to snugly, slidably engage and to overlie substantially the entire said outer surface of said sidewalls between said upper and lower edges, wherein said sleeve is configured to retain the upright shape of said forming member outer surface as bulk materials are loaded into said internal cavity, wherein said sleeve is configured with a fold extending from the lower edges of the sidewalls towards said internal cavity to provide strength resistance to forces directed outwardly and downwardly from the internal cavity, and wherein said sleeve is further folded back upon itself adjacent said lower edge of the sidewalls to provide additional strength to said sleeve adjacent the lower edge; and (c) an insert member sized and configured for placement within said internal cavity.

* * * * *

UNITED STATES PATENT AND TRADEMARK OFFICE

CERTIFICATE OF CORRECTION

PATENT NO. : 6,932,266 B2
DATED : August 23, 2005
INVENTOR(S) : Jones et al.

It is certified that error appears in the above-identified patent and that said Letters Patent is hereby corrected as shown below:

Column 20,
Line 39, "defining un outer" should read -- defining an outer --.
Line 41, "which extend outward" should read -- which exert outward --.
Line 47, "sleeve configured" should read -- sleeve is configured --.

Signed and Sealed this

Twenty-fifth Day of April, 2006

JON W. DUDAS
*Director of the United States Patent and Trademark Office*